US008783738B2

(12) United States Patent
Watanabe et al.

(10) Patent No.: US 8,783,738 B2
(45) Date of Patent: Jul. 22, 2014

(54) VEHICLE LATCH DEVICE

(75) Inventors: Hirofumi Watanabe, Kanagawa (JP); Fuyuki Nakatsuka, Kanagawa (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 467 days.

(21) Appl. No.: 13/089,144

(22) Filed: Apr. 18, 2011

(65) Prior Publication Data

US 2011/0278867 A1 Nov. 17, 2011

(30) Foreign Application Priority Data

May 11, 2010 (JP) ..... 2010-109603

(51) Int. Cl.
*E05C 3/06* (2006.01)
*E05B 65/12* (2006.01)
*E05C 3/00* (2006.01)

(52) U.S. Cl.
CPC ..... *E05B 81/14* (2013.01); *E05B 81/00* (2013.01); *Y10S 292/42* (2013.01)
USPC ..... 292/201; 292/280; 292/DIG. 42

(58) Field of Classification Search
USPC ..... 292/201, DIG. 42, 280, 341.16
See application file for complete search history.

(56) References Cited

U.S. PATENT DOCUMENTS 5,876,074 A * 3/1999 Dowling ..... 292/201
6,223,468 B1 * 5/2001 Kobayashi ..... 49/280
6,422,617 B1 * 7/2002 Fukumoto et al. ..... 292/216
6,499,776 B2 * 12/2002 Takamura ..... 292/201
6,550,826 B2 * 4/2003 Fukushima et al. ..... 292/201
6,557,910 B2 * 5/2003 Amano ..... 292/201
6,637,783 B2 * 10/2003 Takamura ..... 292/201
6,669,247 B2 * 12/2003 Swan ..... 292/201
6,685,239 B2 * 2/2004 Yamauchi et al. ..... 292/201
6,698,804 B2 * 3/2004 Shiota et al. ..... 292/201
7,434,853 B2 * 10/2008 Yamamoto et al. ..... 292/216
7,537,249 B2 * 5/2009 Ichinose et al. ..... 292/216
7,581,767 B2 * 9/2009 Fujihara ..... 292/201
7,699,362 B2 * 4/2010 Taga ..... 292/216
7,762,594 B2 * 7/2010 Arabia et al. ..... 292/201
8,109,542 B2 * 2/2012 Okada et al. ..... 292/201
8,403,378 B2 * 3/2013 Okada et al. ..... 292/201

FOREIGN PATENT DOCUMENTS

JP 2-62066 U 5/1990
JP 8-326387 A 12/1996

(Continued)

*Primary Examiner* — Carlos Lugo
(74) *Attorney, Agent, or Firm* — Foley & Lardner LLP

(57) ABSTRACT

A vehicle latch device including: a releasing unit that rotates about a support shaft provided on a holding member of an electric actuator and includes a cam pin and an output unit that disengages a latch from a ratchet by rotation of the releasing unit about the support shaft, where a driving force of the electric actuator being input to the cam pin; and a gear member that rotates about the support shaft, connects the electric actuator to the releasing unit, and inputs a driving force of the electric actuator into the input unit. The cam pin is arranged to be superimposed on a plane of rotation of the gear member, and the vehicle latch device further includes a cover member that is attached to the holding member and covers at least the support shaft, the input unit, the electric actuator, and the gear member.

5 Claims, 26 Drawing Sheets

(56) References Cited

FOREIGN PATENT DOCUMENTS

| | | | |
|---|---|---|---|
| JP | 2002-201842 | A | 7/2002 |
| JP | 2002-332767 | A | 11/2002 |
| JP | 2006-207192 | A | 8/2006 |
| JP | 2006-225898 | A | 8/2006 |
| JP | 2006-233456 | A | 9/2006 |
| JP | 3985935 | B2 | 7/2007 |

* cited by examiner

LOCKING STATE

LOCKING STATE

UNLOCKING STATE

UNLOCKING STATE

VEHICLE LATCH DEVICE

BACKGROUND OF THE INVENTION

1. Field of the Invention

The present invention relates to a vehicle latch device including an actuator unit.

2. Description of the Related Art

Conventionally, as a vehicle latch device, there has been known a locking device arranged on a vehicle door and capable of not only disengaging a latch from a striker by manipulating a door handle connected to the locking device via an operation cable to open the door, but also disengaging the latch from the striker by operating an electric actuator such as a motor to open the door (see, for example, Japanese Patent No. 3985935).

The conventional locking device disclosed in Japanese Patent No. 3985935 is arranged on a vehicle door. Therefore, there is a probability that cleaning water accompanying vehicle cleaning or rainwater leaks into the locking device from a gap between a door handle and a door and enters into an interior of the locking device via an operation cable. Therefore, it is necessary to prevent water from entering into the locking device. In this case, it can be considered to cover a portion of the locking device including an electric actuator with a case. However, if the portion is simply covered with a case, there is a problem that the locking device is made larger and cannot be arranged on the door.

SUMMARY OF THE INVENTION

According to an aspect of the present invention, a vehicle latch device includes: a releasing unit that rotates about a support shaft provided on a holding member of an electric actuator, and includes an input unit where a driving force of the electric actuator is input and an output unit that disengages a latch from a ratchet by rotation of the releasing unit about the support shaft; a gear member that rotates about the support shaft, connects the electric actuator to the releasing unit, and inputs a driving force of the electric actuator into the input unit; and a cover member that is attached to the holding member and covers at least the support shaft, the input unit, the electric actuator, and the gear member. The input unit is arranged to be superimposed on a plane of rotation of the gear member.

Advantageously, in the vehicle latch device, the gear member is a lock lever including: a gear unit engaged with a worm gear provided on the electric actuator; and a cam groove with which the input unit is slidably engaged. The releasing unit includes: a cable lever being supported by the support shaft, the cable lever including a cable engaging unit, where one end of an operation cable connecting the vehicle latch device to an operation handle being engaged with the cable engaging unit, and an operation output unit that outputs an operation force of the operation handle transmitted via the operation cable to the input unit; and an open lever that includes an input arm and an output arm, where the open lever rotating about the support shaft, a slider provided with the input unit being provided on the input arm to be movable along a longitudinal direction of the input arm, and the output unit being provided on an end of the output arm.

Advantageously, in the vehicle latch device, the support shaft includes a first support shaft and a second support shaft, the cable lever and the open lever rotate about the first support shaft, and the lock lever rotates about the second support shaft.

Advantageously, in the vehicle latch device, the gear member is a cam gear including: a gear unit engaged with a worm gear provided on the electric actuator; and a cam wall with which the input unit is slidably engaged, and the releasing unit includes an open lever including an input arm provided with the input unit and an output arm unit having the output unit provided on an end of the output arm, where the open lever transmitting an input of the input unit to the output unit.

Advantageously, in the vehicle latch device, the support shaft includes a first support shaft and a second support shaft, the open lever rotates about the first support shaft, and the cam gear rotates about the second support shaft.

DETAILED DESCRIPTION OF THE PREFERRED EMBODIMENTS

Exemplary embodiments a vehicle latch device according to the present invention will be explained below in detail with reference to the accompanying drawings.

Figure 1:
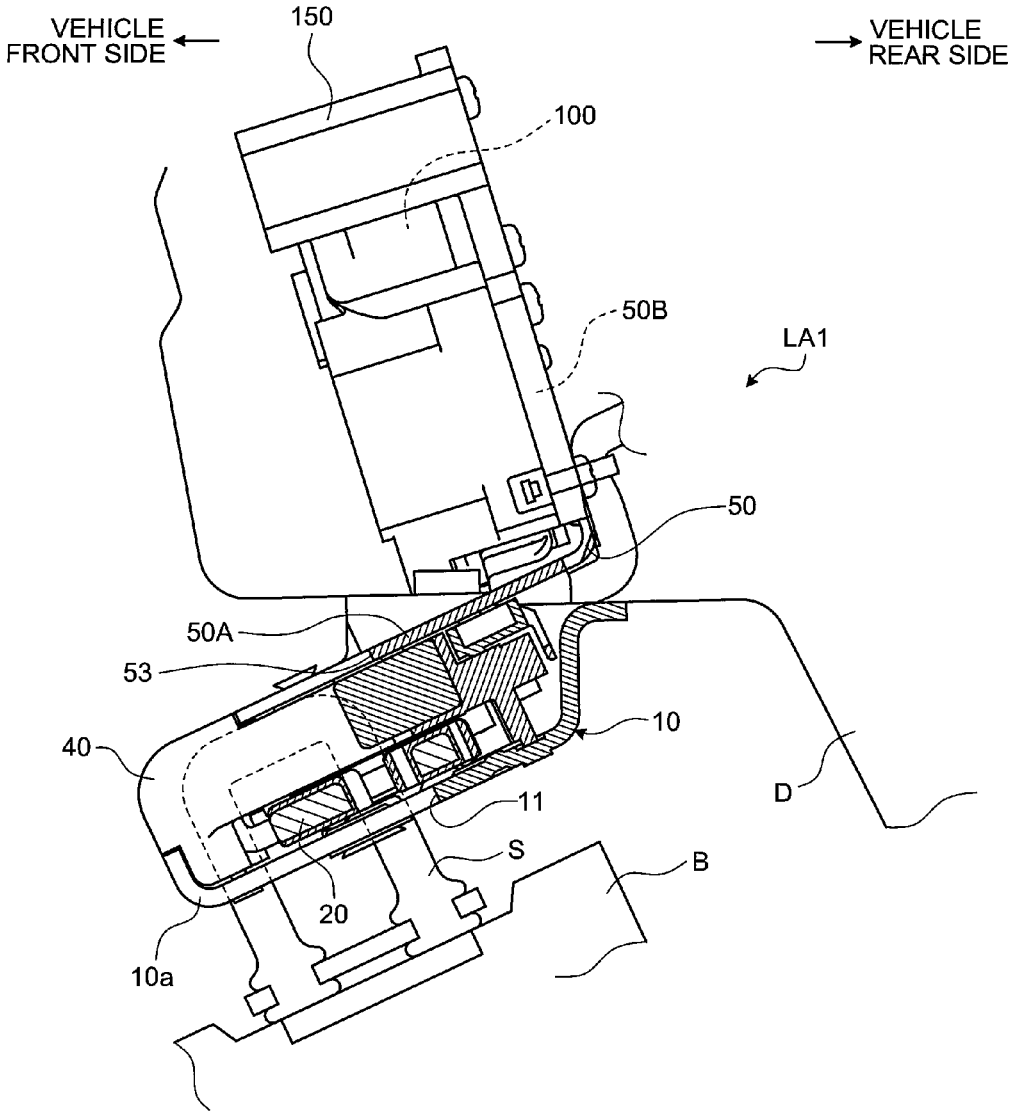
FIG. 1 is a partial cutaway side view of relevant parts of a vehicle latch device according to a first embodiment of the present invention.
Figure 2:
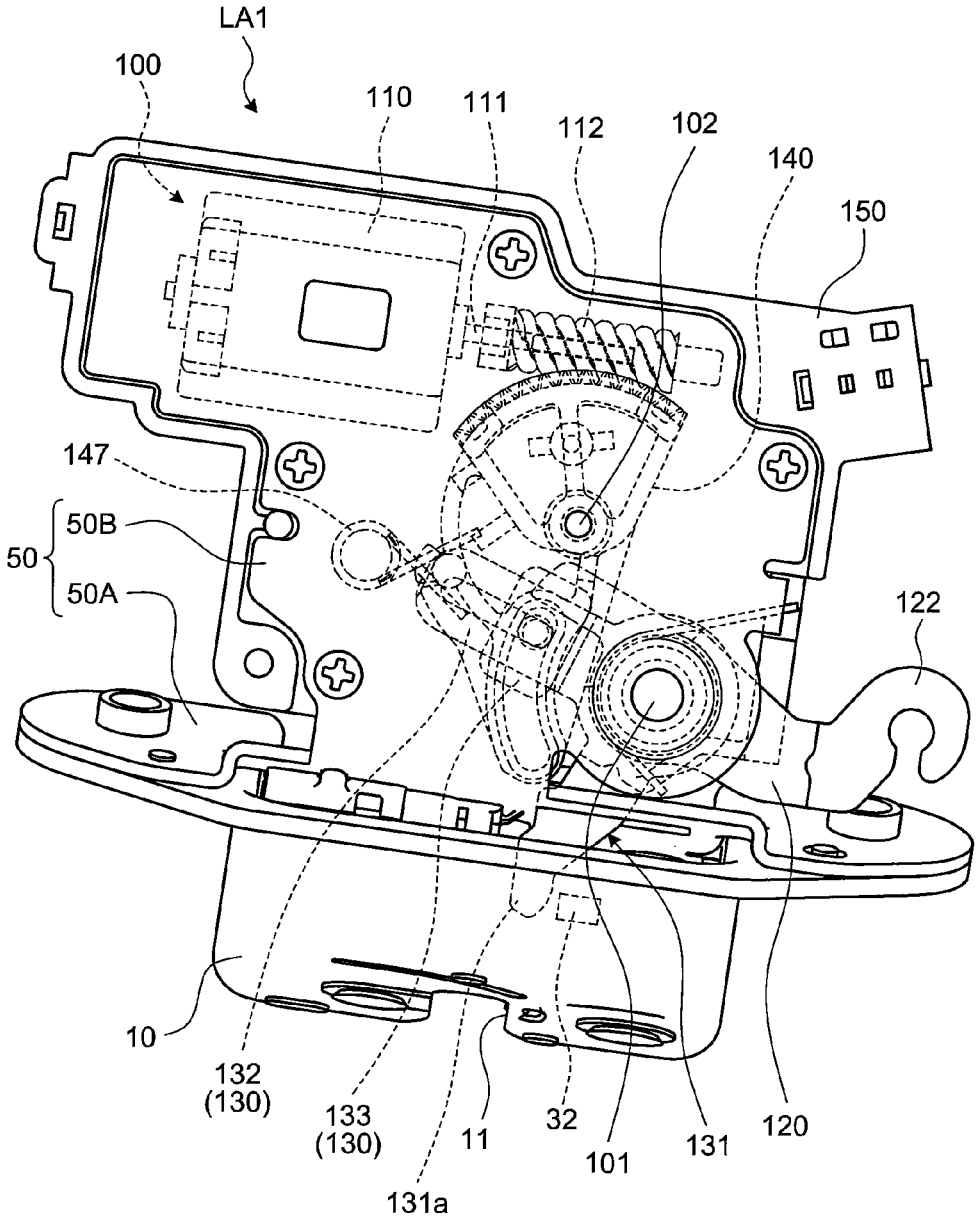
FIG. 2 is a rear view of the vehicle latch device shown in FIG. 1.
Figure 3:
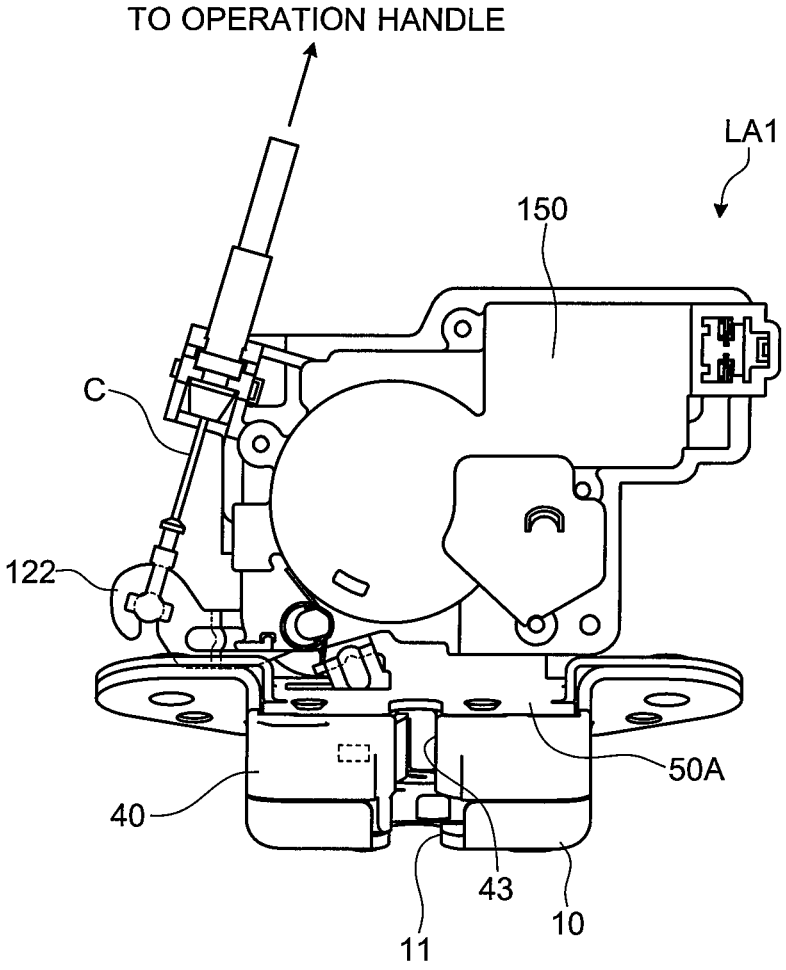
FIG. 3 is a front view of the vehicle latch device shown in FIG. 1.
Figure 4:
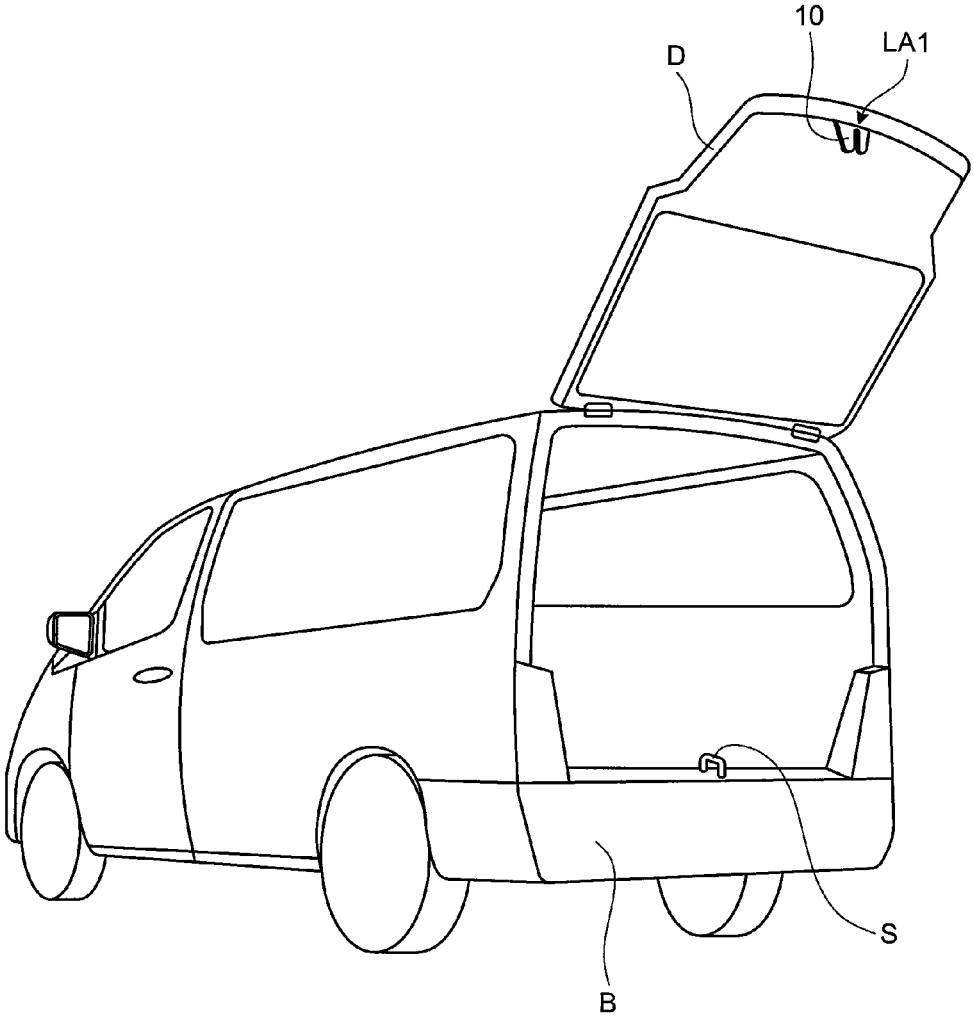
FIG. 4 is a perspective view of a four-wheeled vehicle to which the vehicle latch device shown in FIG. 1 is applied.

FIGS. 1 to 3 depict a vehicle latch device according to a first embodiment of the present invention. A vehicle latch device LA1 exemplarily described here is designed to keep a back door D referred to as "tail gate" closed to a vehicle main body B by engaging the vehicle latch device LA1 with a striker S provided on the vehicle main body B of a four-wheeled vehicle as shown in FIG. 4. The vehicle latch device LA1 is an electric locking/unlocking door latch device a state of which is switched between a locking state and an unlocking state by driving an electric actuator. The back door D, which is supported by an upper edge of a rear end of the vehicle main body B, opens or closes an opening on the rear end of the vehicle main body B by being axially rotated about a center of a shaft along a transverse direction.

Figure 5A:
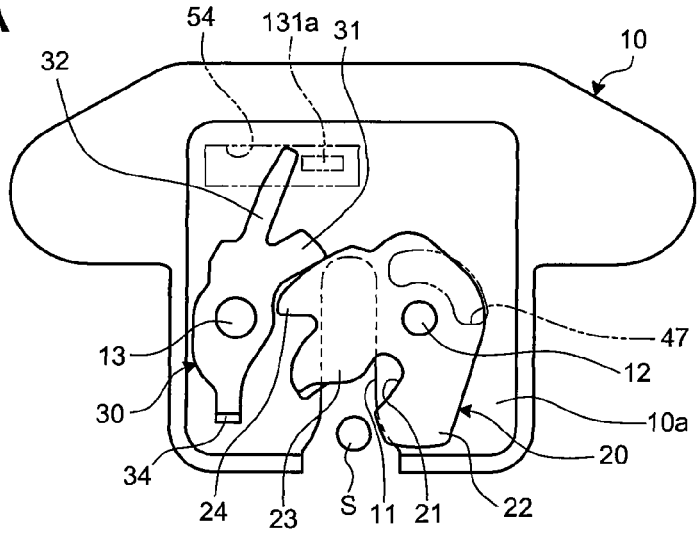
FIGS. 5A, 5B, and 5C are plan views for schematically depicting an engagement state where a striker provided on a vehicle main body is engaged with a latch and a ratchet of the vehicle latch device shown in FIG. 1.
Figure 5B:
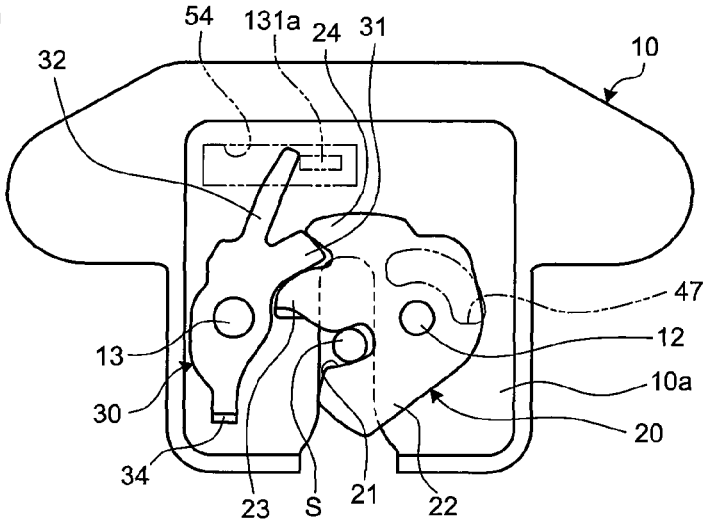
Figure 5C:
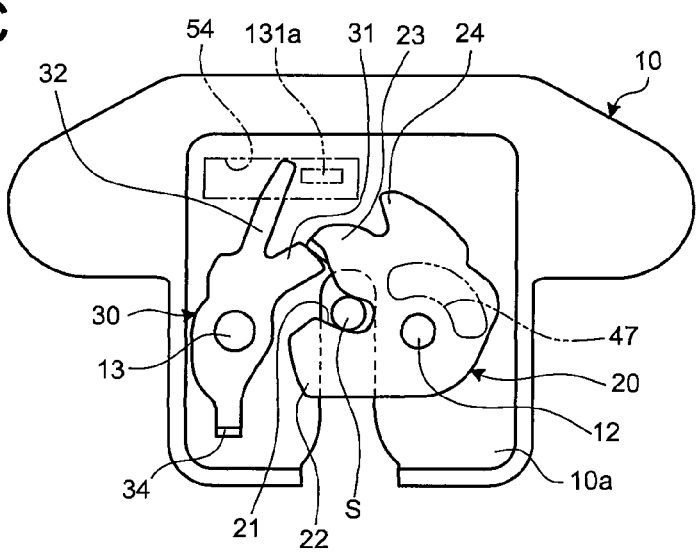
Figure 6:
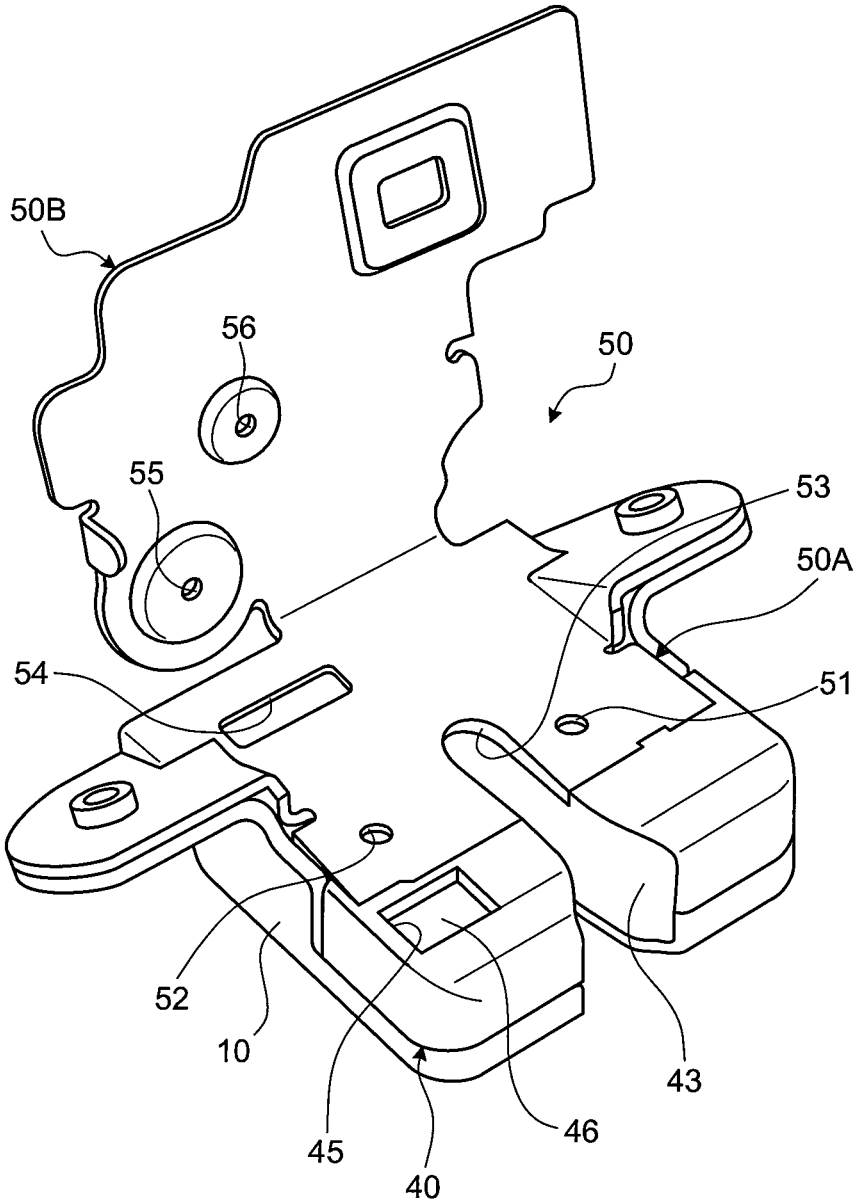
FIG. 6 is a perspective view of a cover plate, a main-unit body, and a back plate applied to the vehicle latch device shown in FIG. 1.

FIGS. 5A to 5C are plan views of the vehicle latch device LA1 for schematically depicting an engagement state where the striker S provided on the vehicle main body B is engaged with a latch 20 and a ratchet 30 of the vehicle latch device LA1 shown in FIG. 1. FIG. 6 is a perspective view of a cover plate 10, a main-unit body 40, and a back plate 50 applied to the vehicle latch device LA1 shown in FIG. 1. As shown in FIGS. 1 to 3, 5, and 6, the vehicle latch device LA1 according to the first embodiment includes the cover plate 10, the main-unit body 40, and the back plate 50.

The cover plate 10 serves as a base of the vehicle latch device LA1 and is made of a relatively thick metal plate. As shown in FIGS. 1 to 3, 5, and 6, a striker entry groove 11 is provided in a plate proximal portion 10*a* in the form of a rectangular concave portion, and a latch shaft 12 and a ratchet shaft 13 are provided on both sides across the striker entry groove 11, respectively. The striker entry groove 11 is a notch formed from a central portion of a front end to an inner portion of the plate proximal portion 10*a* to have a width at which the striker S can enter the striker entry groove 11. The latch shaft 12 and the ratchet shaft 13 are arranged to protrude to an inner surface of the plate proximal portion 10*a* and to be in parallel with each other. The latch shaft 12 rotatably supports the latch 20 and the ratchet shaft 13 rotatably supports the ratchet 30.

Figure 7:
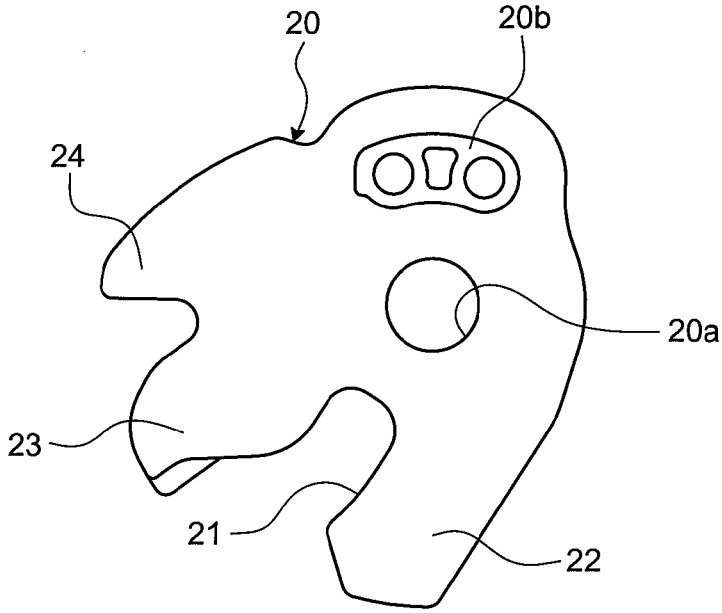
FIG. 7 is a plan view of a latch.

FIG. 7 is a plan view of the latch 20. As shown in FIGS. 5 and 7, the latch 20 is a plate member generally at the center of which an insertion hole 20*a*, into which the latch shaft 12 is inserted, is formed. The latch 20 includes an engagement groove 21 open to an outer peripheral surface, a hook 22 located at the right of the engagement groove 21, a striker abutment unit 23 located at the left of the engagement groove 21, and an outer peripheral pawl 24 located at the left of the striker abutment unit 23. A convex bar 20*b* extending circumferentially about the insertion hole 20*a* is formed on an upper surface of the latch 20 on an opposite side to the insertion hole 20*a*. The latch 20 rotates about a center of the latch shaft 12 so that the engagement groove 21 crosses the striker entry groove 11. A latch spring 25 (see FIG. 9) arranged between the main-unit body 40 and the convex bar 20*b* urges the latch 20 to rotate about the latch shaft 12 in a counterclockwise direction as shown in FIGS. 5A to 5C.

Figure 8:
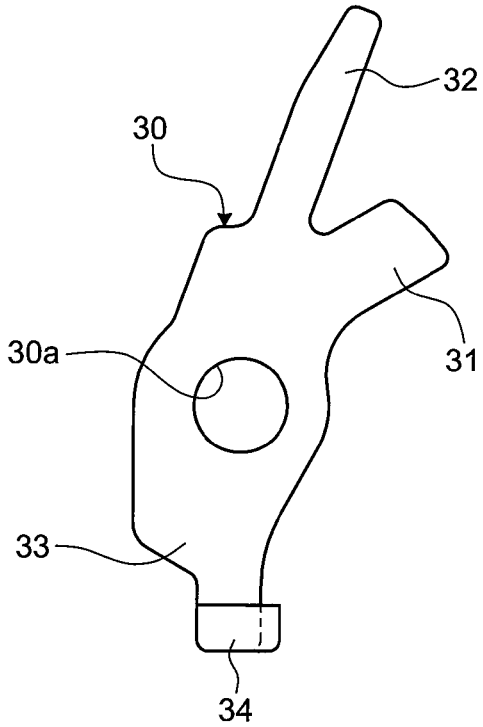
FIG. 8 is a plan view of a ratchet.

FIG. 8 is a plan view of the ratchet 30. As shown in FIGS. 5 and 8, the ratchet 30 is a member in which an insertion hole 30*a*, into which the ratchet shaft 13 is inserted, is formed. The ratchet 30 includes a latch engaging unit 31 extending radially outward of an outer circumference of the insertion hole 30*a*, a first releasing operation unit 32, and a second releasing operation unit 34. The ratchet 30 rotates around a center of the ratchet shaft 13. A ratchet spring 35 (see FIG. 9) arranged between the main-unit body 40 and the first releasing operation unit 32 urges the ratchet 30 to rotate around the ratchet shaft 13 in a clockwise direction as shown in FIGS. 5A to 5C. The latch engaging unit 31 extends radially outward of the ratchet shaft 13, and restricts counterclockwise rotation of the latch 20 as shown in FIGS. 5A to 5C by being engaged with the striker abutment unit 23 or the outer peripheral pawl 24.

As shown in FIG. 5A, when an opening of the engagement groove 21 matches to that of the striker entry groove 11 formed in the plate proximal portion 10*a* and the hook 22 located at the right of the engagement groove 21 recedes from the striker entry groove 11, the latch 20 is not engaged with the striker S. A position of the latch 20 shown in FIG. 5A at which position the latch 20 is not engaged with the striker S is referred to as "unlatched position" of the vehicle latch device LA1. When the latch 20 is at the unlatched position, the back door D can be opened or closed without need to manipulate an operation handle (not shown) provided on the back door D.

Next, when the back door D is closed, the vehicle latch device LA1 approaches the striker S provided on the vehicle main body B so as to be engaged with the striker S. As a result, the latch 20 rotates about the latch shaft 12 in a clockwise direction (hereinafter, "engagement direction") as the latch 20 is engaged with the striker S. As shown in FIG. 5B, the hook 22 turns into a state of crossing the striker entry groove 11 while gradually moving from a front end side to an inner side of the striker entry groove 11. In this state, the latch 20 is engaged with the striker S just before a fully latched position described later. However, the latch 20 is restricted from rotating in a counterclockwise direction (hereinafter, "releasing direction") since the latch engaging unit 31 of the ratchet 30 is engaged with the outer peripheral pawl 24. A position of the latch 20 shown in FIG. 5B is referred to as "half latched position" of the vehicle latch device LA1. When the latch 20 is at the half latched position, the back door D cannot be opened without manipulating an operation handle or the like to switch the position of the latch 20 to the unlatched position.

When the latch 20 rotates further from the half latched position in a clockwise direction, the hook 22 crosses the inner portion of the striker entry groove 11, thereby closing the opening of the striker entry groove 11. In this state, the latch 20 is fully engaged with the striker S and the latch engaging unit 31 abuts on the striker abutment unit 23, so that the latch 20 is restricted from rotating in the releasing direction. A position of the latch 20 shown in FIG. 5C is referred to as "fully latched position" of the vehicle latch device LA1. When the latch 20 is at the fully latched position, the back door D cannot be opened without manipulating the operation handle or the like to switch the position of the latch 20 to the unlatched position.

Figure 9:
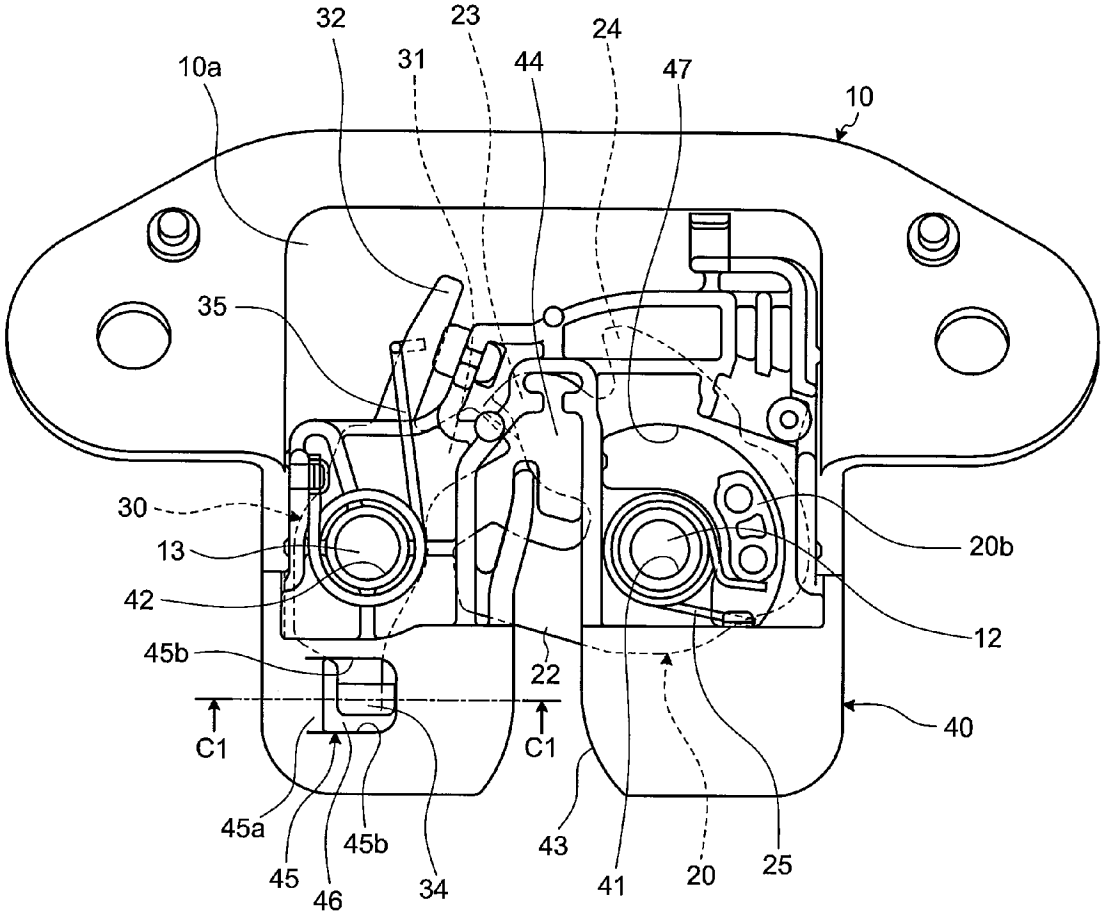
FIG. 9 is a plan view when the latch is at a fully latched position in a state of attaching the main-unit body to the cover plate shown in FIGS. 5A to 5C.
Figure 10:
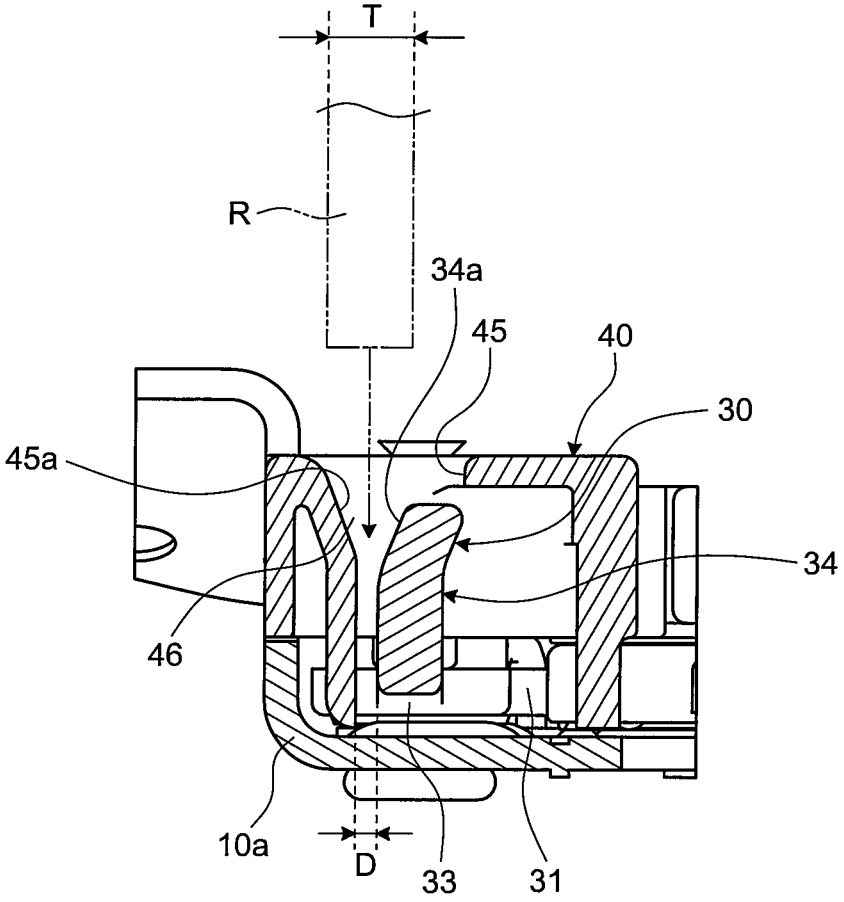
FIG. 10 is a cross-sectional view taken along a line C1-C1 of FIG. 9.

FIG. 9 is a plan view of a case where the latch 20 is at the fully latched position in a state of attaching the main-unit body 40 to the cover plate 10. FIG. 10 is a cross-sectional view taken along a line C1-C1 of FIG. 9. Each of the first releasing operation unit 32 and the second releasing operation unit 34 functions as an operation unit used when rotating the ratchet 30 in a direction away from the latch 20, that is, the counterclockwise direction to disengage the ratchet 30 from the latch 20 and returning the latch 20 to the unlatched position in FIGS. 5A to 5C.

As shown in FIGS. 8, 9, and 10, the first releasing operation unit 32 extends radially outward of an outer circumference of the insertion hole 30*a* at a position adjacent to the latch engaging unit 31. The second releasing operation unit 34 is formed by bending an end of an arm 33 that extends radially outward of the outer circumference of the insertion hole 30*a* at right angle along the ratchet shaft 13.

The second releasing operation unit 34 is arranged in a tool inserting unit 46 while an end thereof is directed toward an opening 45. As shown in FIG. 10, the upper half of the second releasing operation unit 34 is inclined diagonally upward right with respect to the lower half thereof, thereby forming a guide surface 34*a* guiding insertion of a tool R. A space between an inner wall of the tool inserting unit 46 (described later), and a surface of the second releasing operation unit 34 opposed to this inner wall is set to be wider as being closer to the opening 45 and to be narrower than a thickness T of the tool R as being closer to an inner portion of the space. Accordingly, the thickness T of the tool R is set to be larger than a distance D between the inner wall of the tool inserting unit 46 and the surface of the second releasing operation unit 34 opposed to this inner wall in the inner portion of the space. Furthermore, the thickness T of the tool R is set so as to completely disengage the latch engaging unit 31 from the striker abutment unit 23 or the outer peripheral pawl 24 when the second releasing operation unit 34 is pressed to rotate the ratchet 30 about the ratchet shaft 13.

Figure 11:
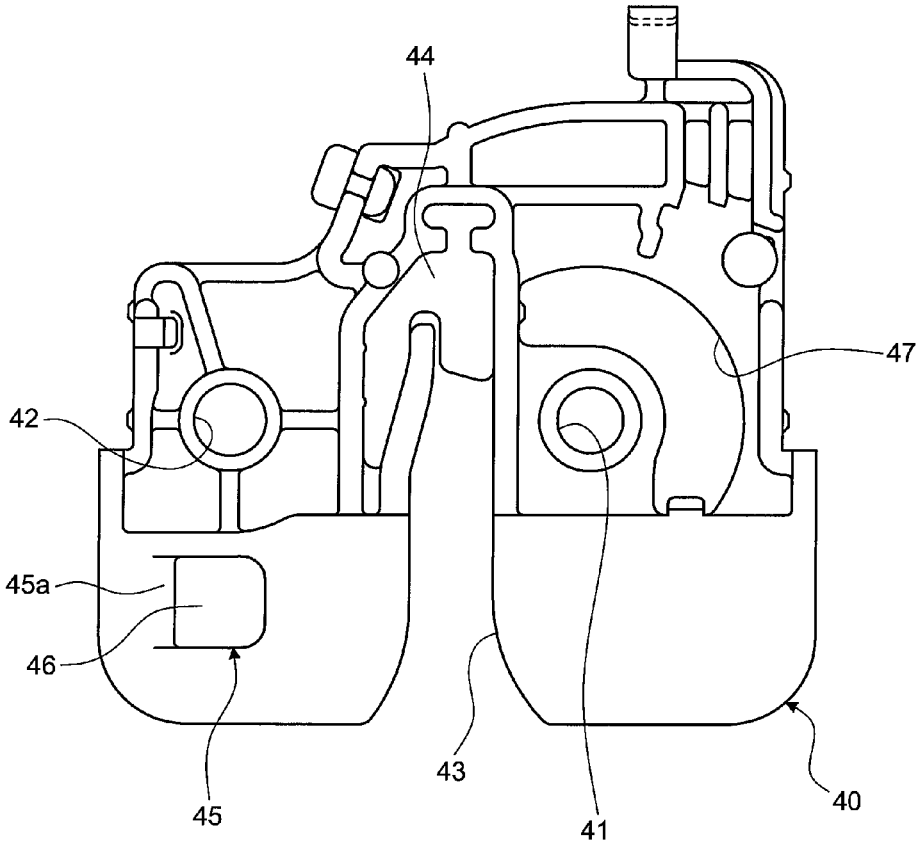
FIG. 11 is a plan view of a front surface of a main-unit body applied to the vehicle latch device shown in FIG. 1.

FIG. 11 is a plan view of a front surface of the main-unit body 40 applied to the vehicle latch device LA1 shown in FIG. 1. The main-unit body 40 is made of a relatively hard synthetic resin and formed into a thick block shape. As shown in FIGS. 6, 9, and 11, an inner surface of a front end of the cover plate 10 in which the latch 20 and the ratchet 30 are arranged is covered with the main-unit body 40. Shaft insertion holes 41 and 42 are formed in the main-unit body 40 at positions corresponding to the latch shaft 12 and the ratchet shaft 13, respectively, and a buffer groove 43 is formed in the main-unit body 40 at a position corresponding to the striker entry groove 11. The shaft insertion holes 41 and 42 are through-holes having inside diameters at which the latch shaft 12 and the ratchet shaft 13 are fitted into the respective shaft insertion holes 41 and 42. Axial lengths of the shaft insertion holes 41 and 42 are set to be smaller than those of the latch shaft 12 and the ratchet shaft 13, respectively. The buffer groove 43 is a notch provided from a central portion of a front end to a distal end of the main-unit body 40 and formed to be slightly narrower than the striker entry groove 11. The buffer groove 43 has an opening end of a size so that the striker S can be inserted into the buffer groove 43, and is formed to be gradually narrower as being closer to an inner portion thereof. An elastic member 44 serving as a cushion is attached into the innermost portion of the buffer groove 43.

As shown in FIGS. 6, 9, and 11, the opening 45 is formed in a front portion of the main-unit body 40 into which the striker S enters, and the tool inserting unit 46 in which the second releasing operation unit 34 is arranged is formed inside of the opening 45. A long hole 47 provided radially around the shaft insertion hole 41 is formed in the main-unit body 40 at a position adjacent to the shaft insertion hole 41. In the opening 45, the appropriate tool R such as a vehicle key or on-vehicle tool is inserted into the tool inserting unit 46 at the time of emergency, and the second releasing operation unit 34 of the ratchet 30 is thereby manipulated from outside to disengage the ratchet 30 from the latch 20, thereby disengaging the latch 20 from the striker S by one action. As shown in FIG. 10, in the opening 45, the upper half of the inner wall of the tool inserting unit 46 opposed to the surface of the second releasing operation unit 34 having the guide surface 34*a* formed thereon is inclined diagonally upward left with respect to the lower half thereof, thereby forming a guide surface 45*a* guiding insertion of the tool R. The main-unit body 40 is thereby formed so that the space between the inner wall of the tool inserting unit 46 and the surface of the second releasing operation unit 34 near an inlet from which the tool R is inserted is wider than the space in the inner portion. As shown in FIG. 9, restriction walls 45*b* restricting a positional deviation between the tool R to be inserted and the second releasing operation unit 34 are formed at positions adjacent to a wall on which the guide surface 45*a* is formed, respectively. The long hole 47 permits the latch 20 to rotate about the latch shaft 12 by engagement of the convex bar 20*b*.

As shown in FIG. 6, the back plate 50 is a plate member that includes a latch cover 50A with which an inner portion-side surface of the main-unit body 40 is covered, and a unit holder 50B bent from an inner potion of the latch cover 50A in a direction away from the main-unit body 40.

Shaft attachment holes 51 and 52 are formed in the latch cover 50A at positions corresponding to the shaft insertion holes 41 and 42 of the main-unit body 40, respectively, and a notch 53 is formed in the latch cover 50A at a position corresponding to the striker entry groove 11 of the cover plate 10. The latch cover 50A is attached to the cover plate 10 by screwing a distal end of the latch shaft 12 and that of the ratchet shaft 13 with the shaft attachment holes 51 and 52, respectively. A lever insertion opening 54 is provided in the latch cover 50A at a position corresponding to the first releasing operation unit 32 of the ratchet 30. The lever insertion opening 54 is an opening for manipulating the first releasing operation unit 32 from outside, and formed into a rectangular shape along a transverse direction of the latch cover 50A. An end of an output arm 131 of an open lever 130 (described later) moves in the transverse direction by rotation of the open lever 130.

As shown in FIGS. 1 and 2, the unit holder 50B is a unit that holds an actuator unit 100. As shown in FIG. 6, support holes 55 and 56 supporting an open lever shaft 101 and a lock lever shaft 102 are formed in a surface of the unit holder 50B, respectively, which surface is on the latch cover 50A side.

The actuator unit 100 is an electric actuator that switches the vehicle latch device LA1 between a locking state and an unlocking state as will be described later. As shown in FIG. 2, the actuator unit 100 includes a cable lever 120, the open lever 130, a lock lever 140, and an electric motor 110.

Figure 12A:
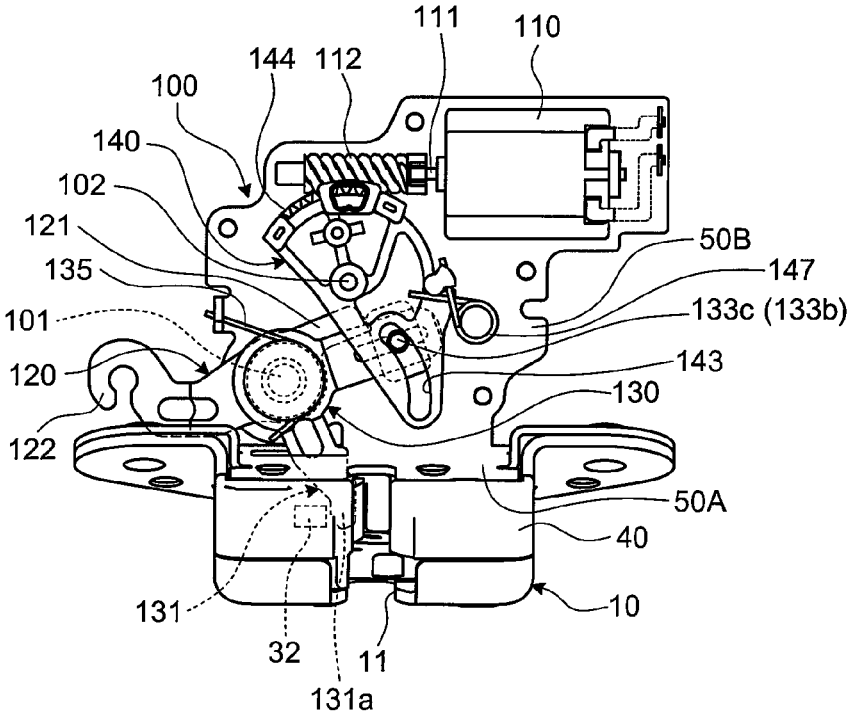
FIGS. 12A and 12B are front views of an operation performed by an actuator unit from which a unit cover is detached when the vehicle latch device shown in FIG. 1 is in a locking state.
Figure 12B:
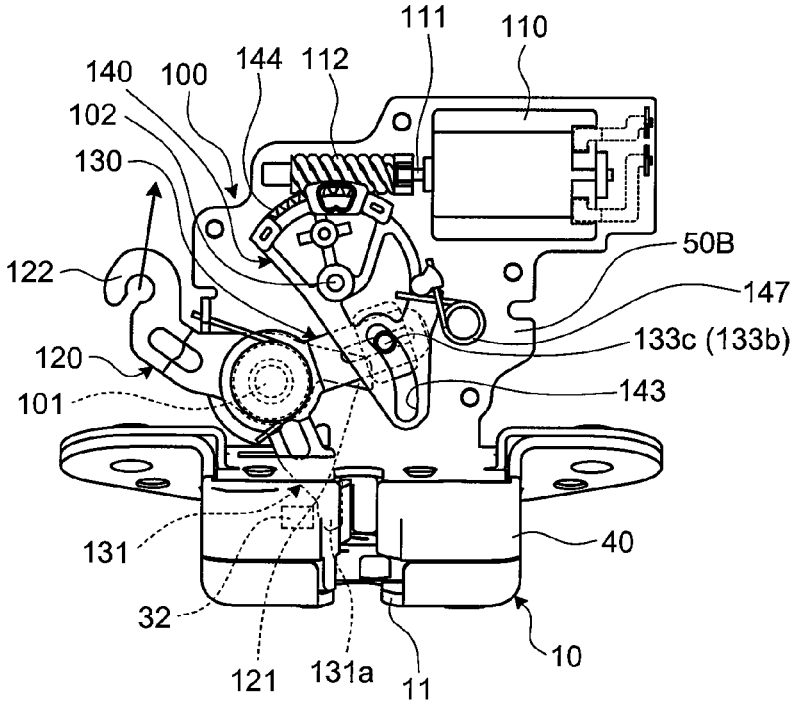
Figure 13A:
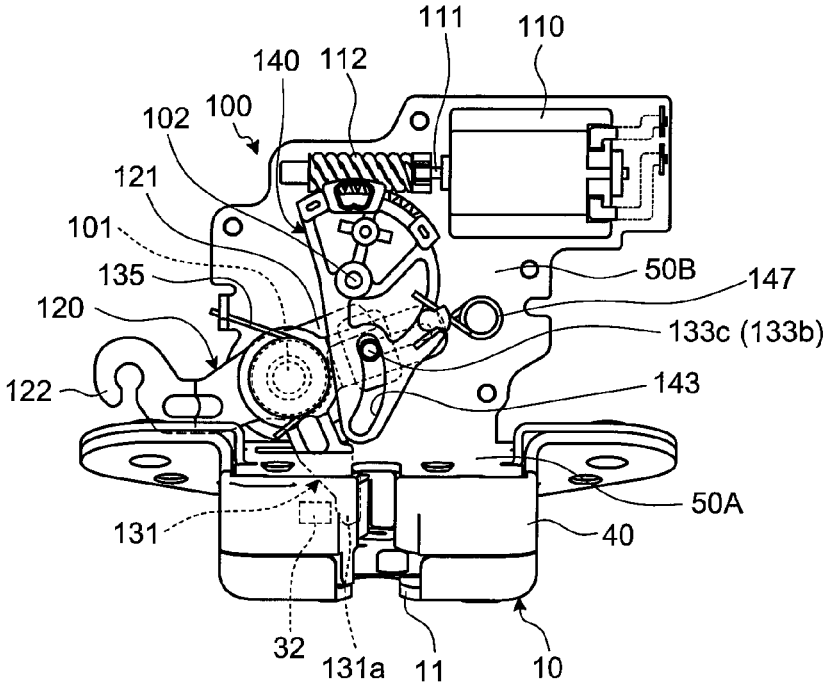
FIGS. 13A and 13B are front view of an operation performed by an actuator unit from which a unit cover is detached when the vehicle latch device shown in FIG. 1 is in an unlocking state.
Figure 13B:
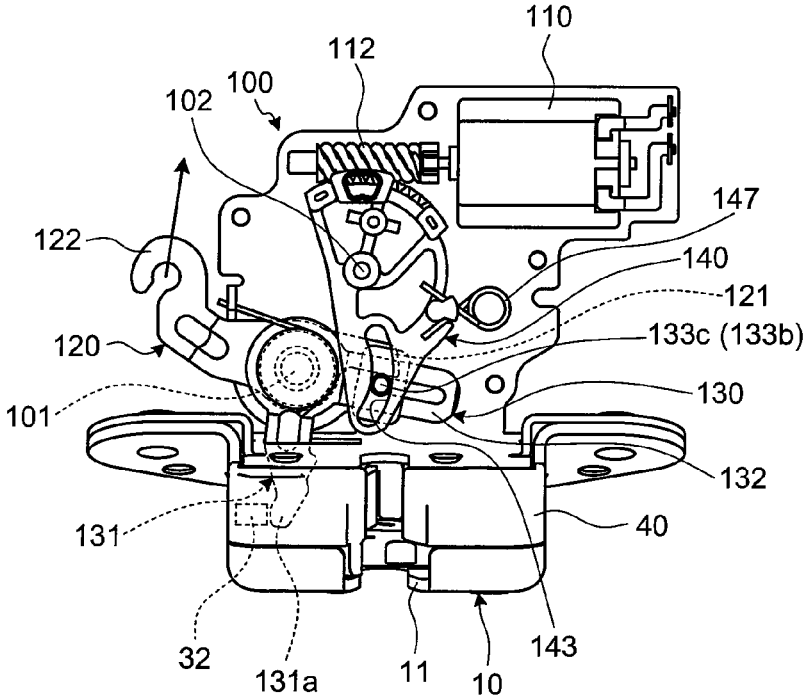

FIGS. 12A and 12B are front views of the vehicle latch device LA1 shown in FIG. 1 for depicting an operation performed by the actuator unit 100 from which a unit cover 150 is detached when the vehicle latch device LA1 shown in FIG. 1 is in the locking state. FIGS. 13A and 13B are front views of the vehicle latch device LA1 shown in FIG. 1 for depicting an operation performed by the actuator unit 100 from which the unit cover 150 is detached when the vehicle latch device LA1 shown in FIG. 1 is in the unlocking state. The cable lever 120 and the open lever 130 are a releasing unit according to the present invention for releasing engagement of the latch 20 with the ratchet 30 (disengaging the latch 20 from the ratchet 30). As shown in FIGS. 12 and 13, the cable lever 120 and the open lever 130 are rotatably supported by the open lever shaft 101 provided on a side edge of the actuator unit 100 proximate to the lever insertion opening 54 (see FIG. 6) of the unit holder 50B.

Figure 14:
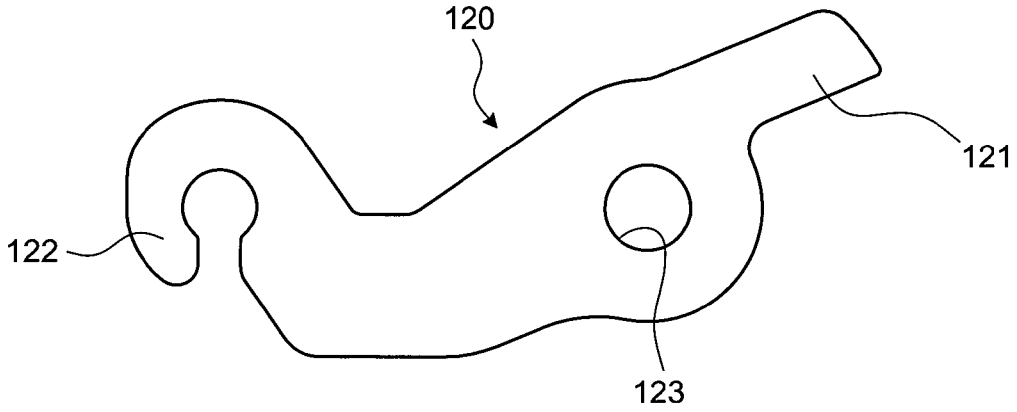
FIG. 14 is a front view of a cable lever applied to the actuator unit of the vehicle latch device shown in FIG. 1.

FIG. 14 is a front view of the cable lever 120 applied to the actuator unit 100 of the vehicle latch device LA1 shown in FIG. 1. The cable lever 120 is arranged between the unit holder 50B and the open lever 130. As shown in FIG. 14, the cable lever 120 includes an operation output unit 121, a cable engaging unit 122, and a shaft hole 123 into which the open lever shaft 101 is inserted. The operation output unit 121 is provided radially outward of the shaft hole 123. The cable engaging unit 122 is provided radially outward of the shaft hole 123 at a position opposed to the operation output unit 121 and an end of the cable engaging unit 122 protrudes outward from one side edge of the unit holder 50B. As shown in FIG. 3, one end of an operation cable C connecting the vehicle latch device LA1 to an operation handle provided on the back door D is engaged with the end of the cable engaging unit 122.

Figure 15:
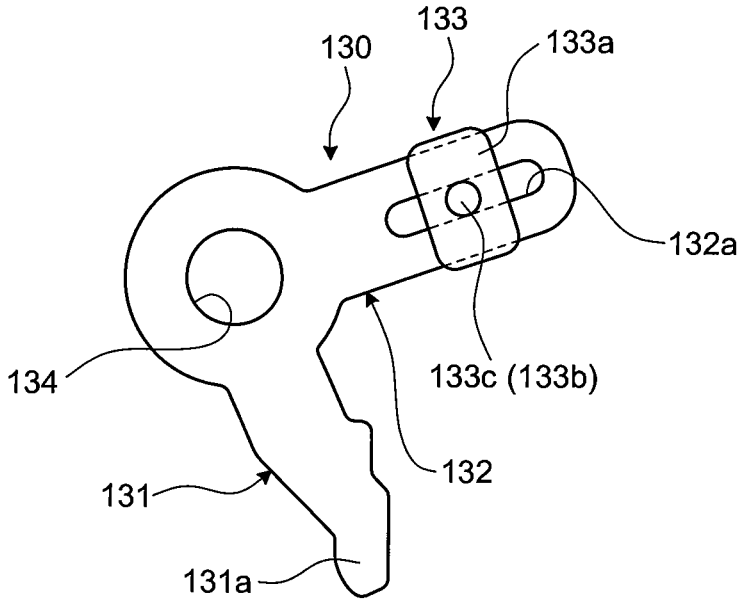
FIG. 15 is a front view of an open lever applied to the actuator unit of the vehicle latch device shown in FIG. 1.

FIG. 15 is a front view of the open lever 130 applied to the actuator unit 100 of the vehicle latch device LA1 shown in FIG. 1. The open lever 130 is arranged at a position at which the open lever 130 is superimposed on the cable lever 120 in an axial direction of the open lever shaft 101. As shown in FIG. 15, the open lever 130 includes a output arm 131, an input arm 132, and a shaft hole 134 into which the open lever shaft 101 is inserted.

The output arm 131 is provided radially outward of the shaft hole 134, and an output unit 131*a* inserted into an interior of the latch cover 50A from the lever insertion hole 54 is provided on an end of the output arm 131. As indicated by a two-dot chain line of FIGS. 5A, 5B, and 5C, the output unit 131*a* is located at the right of the first releasing operation unit 32. When the open lever 130 rotates around the open lever shaft 101 in a clockwise direction in FIGS. 12A and 12B, and 13A and 13B, the open lever 130 presses the first releasing operation unit 32 to switch the position of the latch 20 to the unlatched position shown in FIG. 5A.

As shown in FIG. 15, the input arm 132 is provided radially outward of the shaft hole 134 at a position deviated at about 90° from the output arm 131. A slit 132*a* as well as a slider 133 is formed on an end of the input arm 132 along a longitudinal direction of the input arm 132. The slider 133 includes a slide proximal portion 133*a* provided movably along the longitudinal direction of the input arm 132, an engagement pin 133*b* provided on a surface of the slide proximal portion 133*a* which surface is opposed to the unit holder 50B and protruding from the slit 132*a*, and a cam pin 133*c* protruding from a surface of the slide proximal portion 133*a* which surface is away from the unit holder 50B. The cam pin 133*c* is an input unit to which a driving force of the electric motor 110 is input. When the slider 133 is arranged on a shaft hole 134 side of the input arm 132 and the open lever 130 rotates about the open lever shaft 101 in a clockwise direction in FIGS. 12A and 12B, and 13A and 13B, the engagement pin 133*b* is engaged with the operation output unit 121 of the cable lever 120. When the slider 133 moves toward a distal end of the input arm 132, the engagement pin 133*b* is disengaged from the operation output unit 121 of the cable lever 120. As shown in FIGS. 12 and 13, an open lever spring 135 that always rotates the open lever 130 in a counterclockwise direction is interposed between the open lever 130 and the unit holder 50B.

Figure 16:
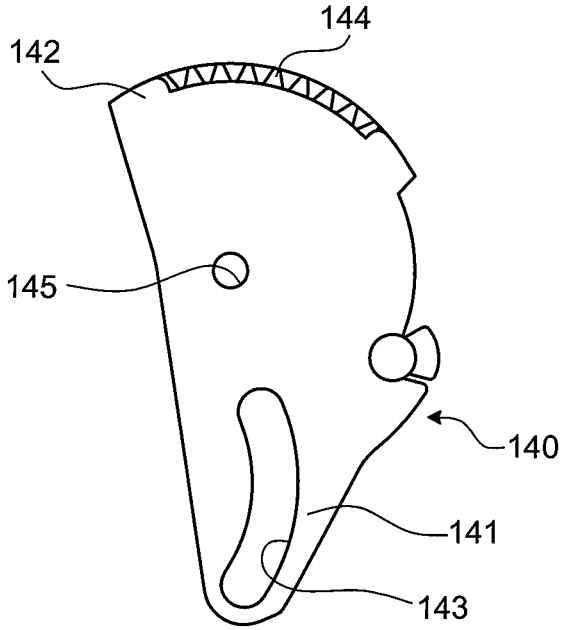
FIG. 16 is a front view of a lock lever applied to the actuator unit of the vehicle latch device shown in FIG. 1.

FIG. 16 is a front view of the lock lever 140 applied to the actuator unit 100 of the vehicle latch device LA1 shown in FIG. 1. The lock lever 140 is a gear member that connects the electric motor 110 to the open lever 130 serving as a releasing unit, and that inputs the driving force of the electric motor 110 into the cam pin 133*c* serving as an input unit of the open lever 130.

As shown in FIGS. 12, 13, and 16, the lock lever 140 is supported rotatably by the lock lever shaft 102 provided at a position closer to a center of the unit holder 50B than the open lever shaft 101 and away from a bent portion of the latch cover 50A. The lock lever 140 includes a cam lever 141, a sector gear unit 142, and a shaft hole 145 into which the lock lever shaft 102 is inserted, and is supported by the lock lever shaft 102 while the cam lever 141 is superimposed on the input arm 132 of the open lever 130. The cam lever 141 is provided radially outward of the shaft hole 145 and a cam groove 143 in the form of a long hole is formed in the cam lever 141. The cam groove 143 is formed to be bent along a circular arc around the open lever shaft 101 when the lock lever 140 is attached to the unit holder 50B as a part of the actuator unit 100, and the cam pin 133*c* of the slider 133 of the open lever 130 is slidably engaged with the cam groove 143. The sector gear unit 142 is formed into a sector shape around the shaft hole 145 at a position opposed to the cam lever 141, and a gear 144 is formed on a circular arc-shaped outer circumferential surface of the sector gear unit 142.

Figure 17:
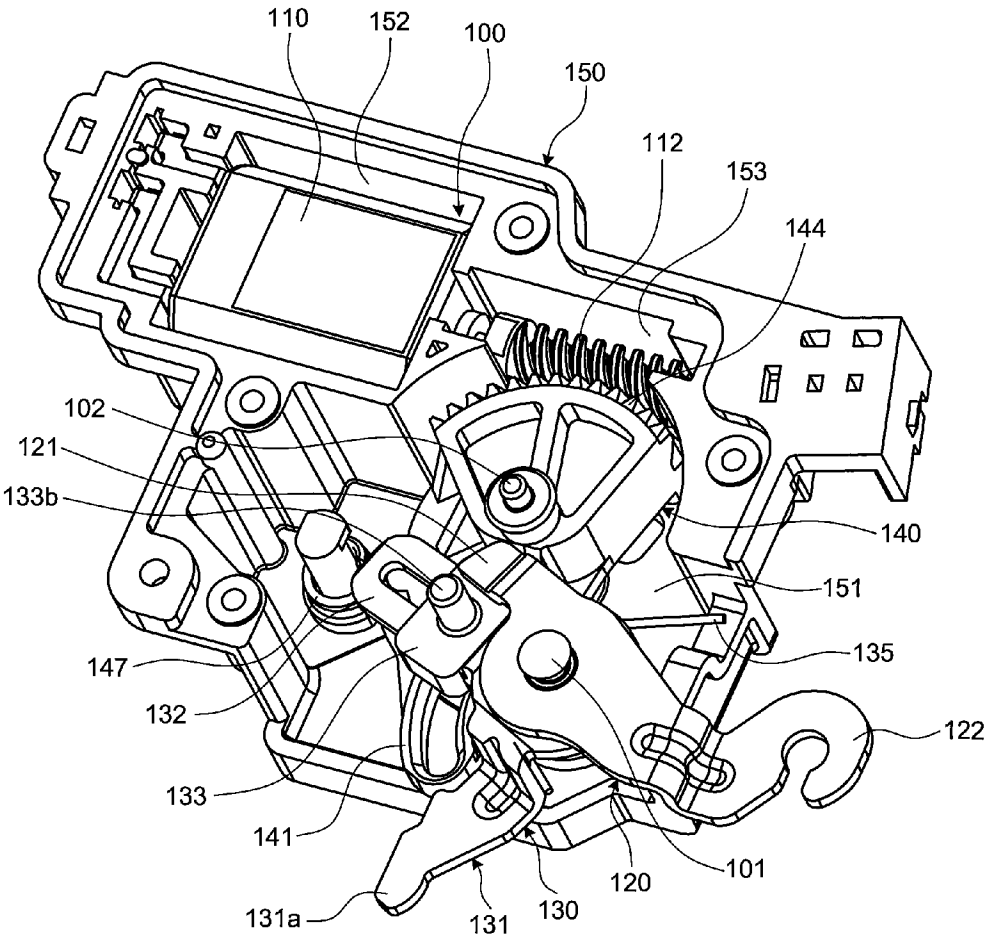
FIG. 17 is a perspective view of an interior of the actuator unit, from which the unit cover is detached, as well as an electric motor, a cable lever, and an open lever accommodated in the unit cover when the vehicle latch device shown in FIG. 1 is in a locking state.

Accordingly, as shown in FIGS. 12, 13, and 17, the cam pin 133*c* of the open lever 130 as well as the operation output unit 121 of the cable lever 120 is arranged to be superimposed on a plane of rotation of the lock lever 140 as the gear member around the lock lever shaft 102 of the lock lever 140. At this time, the lock lever 140 moved to a locking position or unlocking position (described later) as a result of rotation is held to the locking or unlocking position by an over-center spring 147 accommodated in the unit cover 150 (described later) (see FIGS. 2, 12, 13, and 17).

As shown in FIGS. 2, 12, and 13, the electric motor 110 is arranged at a position farthest from the open lever shaft 101 on the unit holder 50B, and a worm gear 112 is provided on an output shaft 111. The worm gear 112 is engaged with the gear 144 formed on the sector gear unit 142 of the lock lever 140, and rotates the lock lever 140 around a center of the lock lever shaft 102 when the electric motor 110 is driven.

As shown in FIGS. 1 to 3, the actuator unit 100 described above is provided with the unit cover 150. The unit cover 150 is made of a synthetic resin, is the size enough to cover up the entirety of the actuator unit 100 except for the cable engaging unit 122 of the cable lever 120, and is attached to the unit holder 50B by fastening means such as a screw. At this time, in the unit cover 150, as shown in FIG. 17, the cable lever 120, the open lever 130, and the lock lever 140 are accommodated in an operation concave portion 151, the electric motor 110 is accommodated in a driving concave portion 152, and the worm gear 112 is accommodated in a driving concave portion 153.

In the vehicle latch device LA1 configured as described above, when the closed back door D is to be locked, then the electric motor 110 is driven in a state of closing the back door D and the lock lever 140 is rotated around the lock lever shaft 102 in a counterclockwise direction. Accordingly, the lock lever 140 is arranged at the position shown in FIG. 12A, and the slider 133 of the open lever 130 is moved to the distal end of the input arm 132 via the cam pin 133*c* engaged with the cam groove 143, thereby turning into a locking state.

In the vehicle latch device LA1 in this locking state, when an operation handle provided on the back door D is manipulated to open the back door D and the cable engaging unit 122 is pulled in a direction indicated by an arrow shown in FIG. 12B via the operation cable C, the cable lever 120 rotates in a clockwise direction. However, the slider 133 of the open lever 130 is located near the distal end of the input arm 132. Accordingly, the operation output unit 121 of the cable lever 120 is not engaged with the engagement pin 133*b* of the slider 133.

Accordingly, in a case of the vehicle latch device LA1 in the locking state, even when the operation handle is manipulated to open the back door D, then the open lever 130 does not rotate, and the output arm 131 of the open lever 130 does not press the first releasing operation unit 32 of the ratchet 30. Therefore, the first releasing operation unit 32 does not disengage the ratchet 30 from the latch 20, and the vehicle latch device LA1 in the locking state does not permit the back door D to be opened even when the operation handle is manipulated to open the back door D.

On the other hand, the electric motor 110 is driven in a state where the back door D is closed, thereby turning the vehicle latch device LA1 into the unlocking state. In this state, in the vehicle latch device LA1, the lock lever 140 rotates about the lock lever shaft 102 in a clockwise direction from the position shown in FIGS. 12A and 12B to be arranged at the position shown in FIG. 13A, and the slider 133 of the open lever 130 moves toward the shaft hole 134 of the input arm 132 via the cam pin 133*c* engaged with the cam groove 143.

In the vehicle latch device LA1 in this unlocking state, when an operation handle provided on the back door D is manipulated to open the back door D and the cable engaging unit 122 is pulled in a direction indicated by an arrow shown in FIG. 13B via the operation cable C, the cable lever 120 rotates in a clockwise direction. In a case of this unlocking state, the slider 133 of the open lever 130 is located near the shaft hole 134 of the input arm 132. Accordingly, the operation output unit 121 of the cable lever 120 is engaged with the engagement pin 133*b* of the slider 133.

Accordingly, in the vehicle latch device LA1 in the unlocking state, when the operation handle is manipulated to open the back door D, the open lever 130 rotates in a clockwise direction via the slider 133 to permit the output arm 131 to press the first releasing operation unit 32 of the ratchet 30 as shown in FIG. 13*b*, thereby rotating the ratchet 30 in a counterclockwise direction in FIGS. 5A to 5C. Therefore, the ratchet 30 is disengaged from the latch 20, the latch 20 rotates to be arranged at the unlatched position shown in FIG. 5A, and the latch 20 is disengaged from the striker S. As a result, the vehicle latch device LA1 in the unlocking state permits the back door D to be opened by manipulating the operation handle to open the back door D.

However, at the time of emergency when power cannot be supplied to the actuator unit 100 because of a failure in an electric system, running out of a battery or the like, the vehicle latch device LA1 cannot be switched from the locking state to the unlocking state, making it impossible to open the closed back door D. Therefore, at such a time of emergency, a passenger disengages the ratchet 30 from the latch 20 manually as described later to switch the position of the latch 20 to the unlatched position shown in FIG. 5B, regardless of whether the vehicle latch device LA1 is in the unlocking state or in the locking state.

Figure 18:
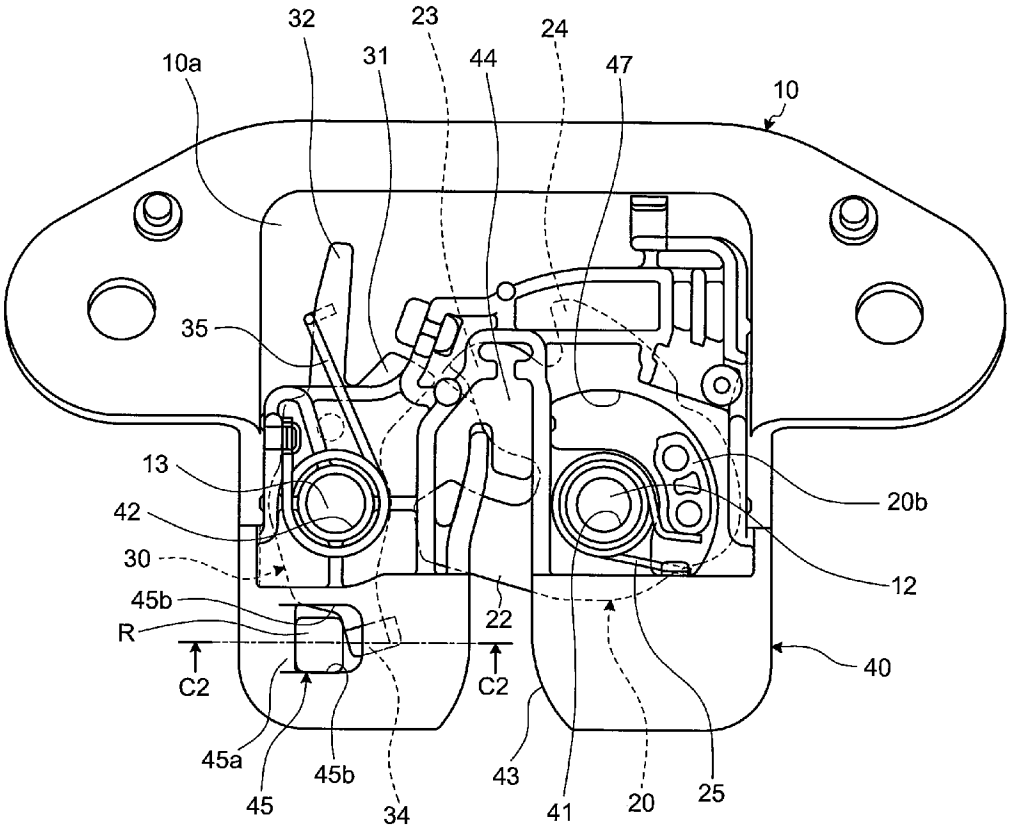
FIG. 18 is a plan view of a state of rotating the ratchet shown in FIG. 9 in a direction away from the latch.
Figure 19:
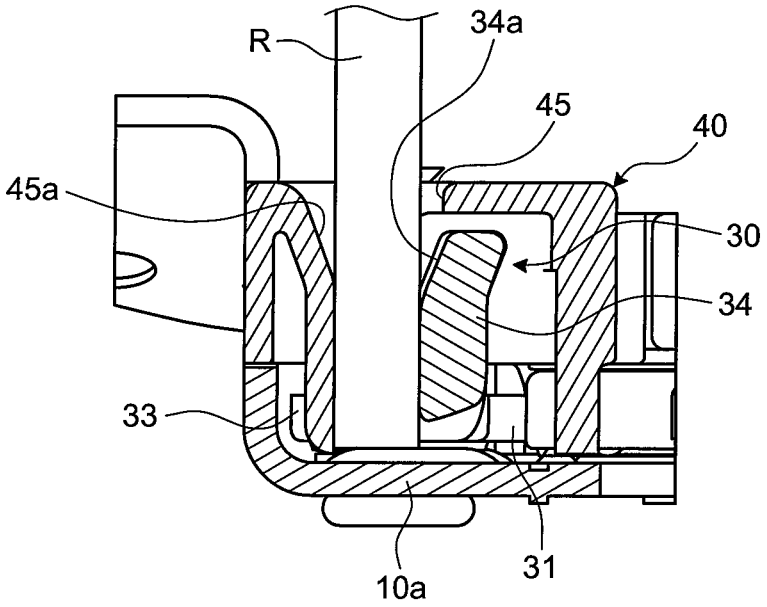
FIG. 19 is a cross-sectional view taken along a line C2-C2 of FIG. 18.

FIG. 18 is a plan view of the vehicle latch device LA1 for depicting a state of rotating the ratchet 30 in a direction away from the latch 20. FIG. 19 is a cross-sectional view of the vehicle latch device LA1, taken along a line C2-C2 of FIG. 18. As shown in FIG. 10, the tool R is inserted into the opening 45 from upward of the main-unit body 40. The tool R is thereby guided by the guide surface 45*a* of the opening 45 and the guide surface 34*a* of the second releasing operation unit 34 and inserted into a space between the opening 45 and the second releasing operation unit 34. Following this insertion, the tool R presses the second releasing operation unit 34 against a spring force of the ratchet spring 35 rightward in FIGS. 18 and 19, thereby rotating the ratchet 30 about the ratchet shaft 13 in the direction away from the latch 20.

Furthermore, as shown in FIG. 19, a distal end of the tool R abuts on the plate proximal portion 10*a* of the cover plate 10, thus completing insertion of the tool R. Subsequently, as shown in FIG. 18, the latch engaging unit 31 of the ratchet 30 is disengaged from the striker abutment unit 23 of the latch 20, thereby releasing restriction of the rotation of the latch 20 in the releasing direction imposed by the ratchet 30. As a result, the latch 20 is rotated in a counterclockwise direction by a spring force of the latch spring 25 to return to the position of the latch 20 from the fully latched position to the unlatched position as shown in FIGS. 5A to 5C.

Accordingly, the latch 20 is disengaged from the striker S in the vehicle latch device LA1 and the passenger can therefore open the back door D only by pressing the back door D. The tool R can disengage the ratchet 30 from the latch 20 and disengage the latch 20 from the striker S even when the vehicle latch device LA1 is at the half latched position.

As described above, at the time of emergency when the power cannot be supplied to the actuator unit 100 because of a failure in an electric system, running out of a battery or the like, the vehicle latch device LA1 can disengage the ratchet 30 from the latch 20 by the one-action operation of inserting the tool R into the opening 45, enabling the passenger to easily open the back door D.

At this time, as shown in FIGS. 12, 13, and 17, in the vehicle latch device LA1, the cam pin 133*c* of the input arm 132 is arranged to be superimposed on and parallel to the plane of rotation of the lock lever 140. Furthermore, the vehicle latch device LA1 includes the unit cover 150 which is attached to the unit holder 50B and with which at least the open lever shaft 101 supporting the cable lever 120 and the open lever 130, the cam pin 133*c* of the input arm 132, the electric motor 110, and the lock lever 140 are covered. This can suppress entry of water into the vehicle latch device LA1 while preventing the vehicle latch device LA1 from being made larger. Moreover, as shown in FIG. 2, the open lever shaft 101 supports the cable lever 120 and the open lever 130. Accordingly, even if rainwater is to enter into the vehicle latch device LA1 from the cable engaging unit 122 via the operation cable C, the rainwater is introduced from the output arm 131 of the open lever 130 into the cover plate 10 and discharged to the outside of the vehicle latch device LA1.

A vehicle latch device according to a second embodiment of the present invention is described next with reference to the drawings. The vehicle latch device LA1 according to the first embodiment is the electrically locking/unlocking door latch device switched between the locking state and the unlocking state by driving the electric actuator. The vehicle latch device according to the second embodiment, by contrast, is an electrically releasable door latch device for disengaging a latch from a ratchet by driving an electric actuator. A vehicle latch device LA2 according to the second embodiment includes constituent members identical to those of the vehicle latch device LA1 according to the first embodiment except that the vehicle latch device LA2 includes an open lever 160 formed by integrating the cable lever 120 and the open lever 130 included in the vehicle latch device LA1 according to the first embodiment, and includes a cam gear 170 in place of the lock lever 140. Therefore, in the following explanations, constituent elements identical to those of the vehicle latch device LA1 according to the first embodiment are denoted by like reference letters or numerals.

Figure 20:
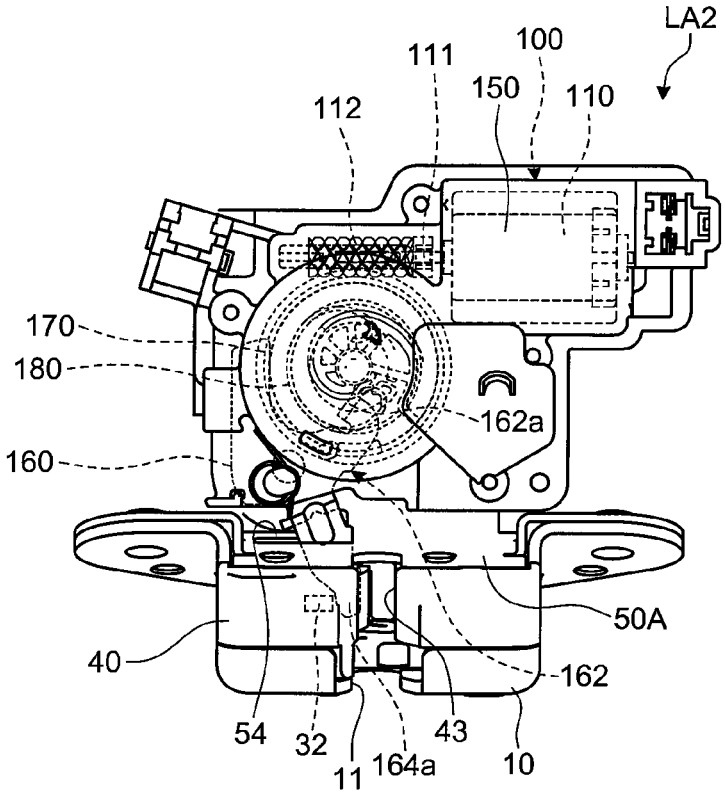
FIG. 20 is a front view of a vehicle latch device according to a second embodiment of the present invention.
Figure 21:
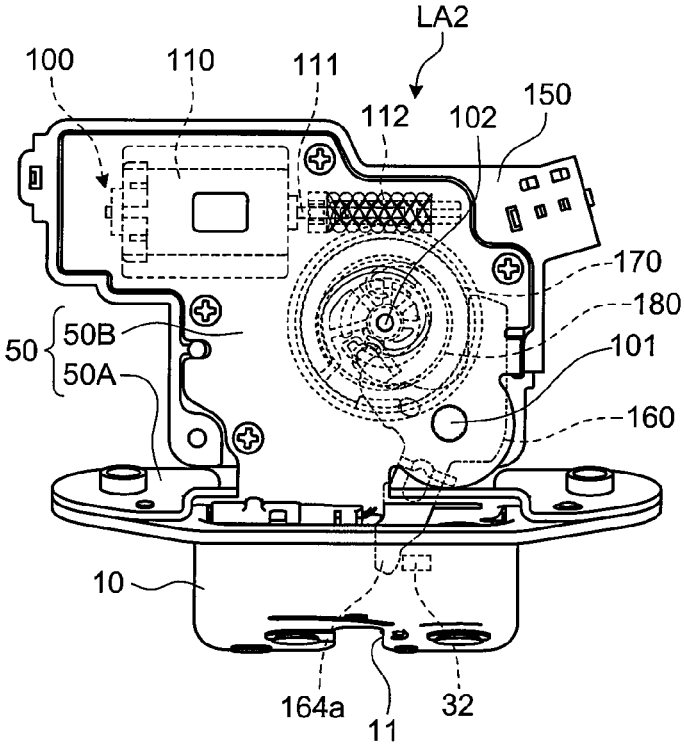
FIG. 21 is a rear view of the vehicle latch device shown in FIG. 20.
Figure 22:
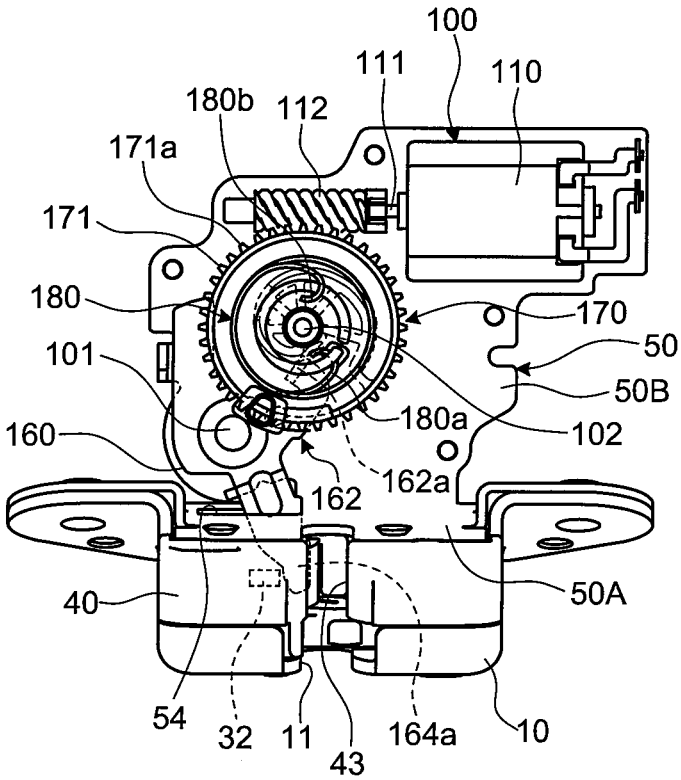
FIG. 22 is a front view of an operation performed by an actuator unit from which a unit cover is detached when the vehicle latch device shown in FIG. 20 is at a fully latched position.
Figure 23:
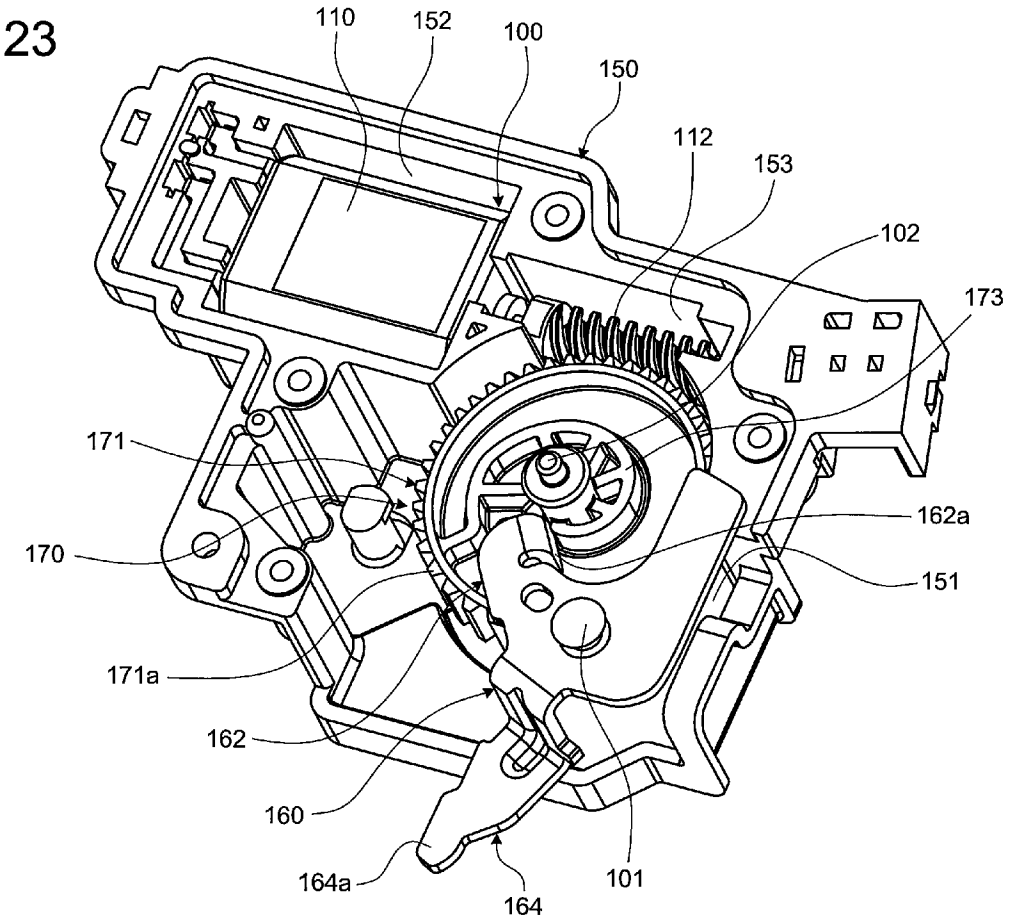
FIG. 23 is a perspective view of an interior of the actuator unit, from which a unit cover is detached, as well as an electric motor, a cam gear, and a cable lever accommodated in the unit cover when the vehicle latch device shown in FIG. 20 is at a fully latched position.
Figure 24:
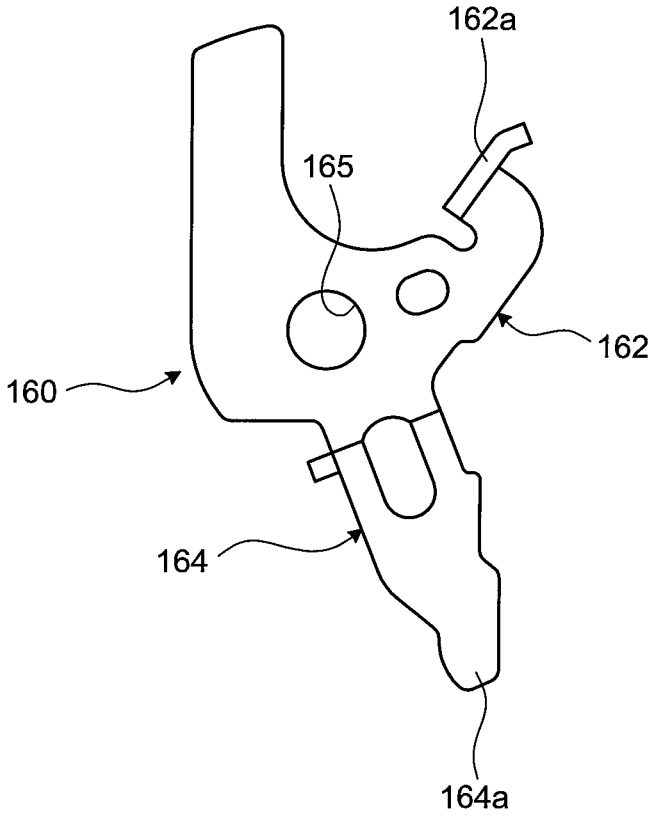
FIG. 24 is a front view of a cable lever applied to the actuator unit of the vehicle latch device shown in FIG. 20.

FIG. 20 is a front view of the vehicle latch device LA2 according to the second embodiment. FIG. 21 is a rear view of the vehicle latch device LA2 shown in FIG. 20. FIG. 22 is a front view of the vehicle latch device LA2 for depicting that a unit cover is detached from an actuator unit when the vehicle latch device LA2 shown in FIG. 20 is at a fully latched position. FIG. 23 is a perspective view of the vehicle latch device LA2 for depicting an interior of the vehicle latch device LA2 when the vehicle latch device LA2 shown in FIG. 20 is at the fully latched position and the unit cover is detached from the actuator unit. FIG. 24 is a front view of a cable lever applied to the actuator unit of the vehicle latch device LA2 shown in FIG. 20.

As shown in FIGS. 20 to 22, the vehicle latch device LA2 includes the cover plate 10, the main-unit body 40, and the back plate 50.

The actuator unit 100 held by the back plate 50 is a driving unit that disengages the latch 20 from the ratchet 30. As shown in FIGS. 20 to 23, the actuator unit 100 includes the electric motor 110, the open lever 160, the cam gear 170, and a return spring 180. These constituent elements, that is, the electric motor 110, the open lever 160, the cam gear 170, and the return spring 180 except for a part of the open lever 160 are accommodated in the unit cover 150 with which a front side of a unit holder 50B is covered. FIGS. 20 to 23 depict initial positions of the open lever 160 and the cam gear 170 before the latch 20 is disengaged from the ratchet 30.

The unit cover 150 is made of a synthetic resin, is the size enough to cover up the entirety of the actuator unit 100 except for an output unit 164*a* of the open lever 160, and is attached to a unit holder 50B by fastening means such as a screw.

As shown in FIGS. 21 to 23, the open lever 160 is rotatably supported by the open lever shaft 101 provided at a position proximate to the lever insertion opening 54 (see FIGS. 6 and 20) of the unit holder 50B. The open lever 160 is arranged between the unit holder 50B and the cam gear 170. As shown in FIG. 24, an input arm 162 is arranged on one side of a shaft hole 165, and an output arm 164 is arranged in a direction orthogonal to the input arm 162 with respect to the shaft hole 165. An input unit 162*a* is provided on an end of the input arm 162. As shown in FIG. 23, the input unit 162*a* is arranged to be superimposed on a plane of rotation of the cam gear 170 around the lock lever shaft 102. The output unit 164*a* is provided on an end of the output arm 164.

An end of the output unit 164*a* is located at the right of the first releasing operation unit 32 in a front view of the vehicle latch device LA2 as indicated by a dotted line shown in FIG. 20, and located at the left of the first releasing operation unit 32 in a rear view of the vehicle latch device LA2 as indicated by a dotted line shown in FIG. 21. Accordingly, in FIG. 22, when the open lever 160 rotates around a center of the open lever shaft 101 in a clockwise direction, then the first releasing operation unit 32 of the ratchet 30 is pressed leftward, and a position of the latch 20 is switched to an unlatched position shown in FIG. 5A. Note that an open lever spring (not shown) that always rotates the open lever 160 in a counterclockwise direction is interposed between the open lever 160 and the unit holder 50B.

Figure 25A:
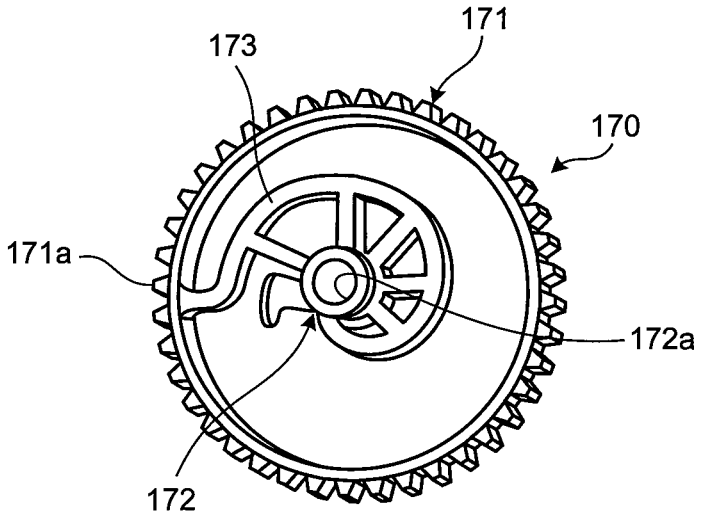
FIGS. 25A and 25B are perspective views of a cam gear.
Figure 25B:
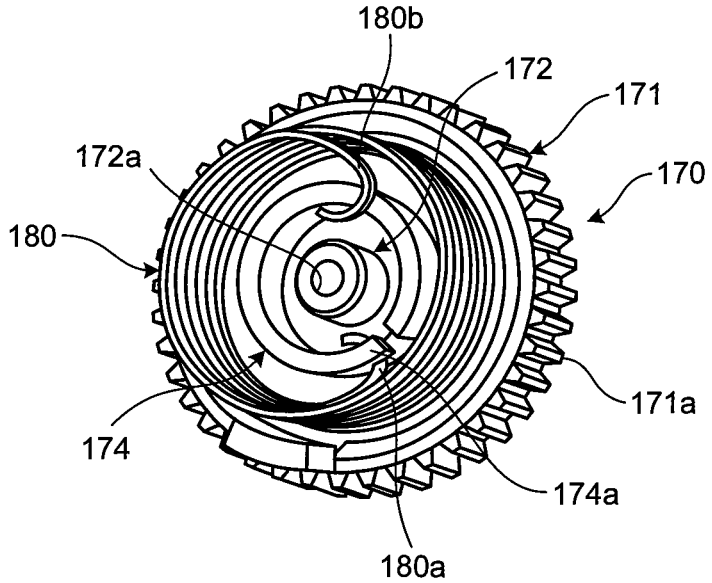

FIGS. 25A and 25B are perspective views of the cam gear 170. As shown in FIGS. 25A and 25B, a gear unit 171*a* constituted by a gear engaged with the worm gear 112 is formed on an outer circumferential wall 171 of the cam gear 170 that is a disk member. A boss 172 having a shaft hole 172*a* formed therein is provided at the center of the cam gear 170 to protrude to both surfaces of the cam gear 170. A cam wall 173 is formed on one surface of the cam gear 170. The cam wall 173 is formed spirally from an outer circumferential portion of the boss 172 so that a distance from a center of the shaft hole 172*a* gradually longer following rotation of the cam gear 170. In FIG. 23, when the came gear 170 rotates in a clockwise direction, the cam gear 170 abuts on the input unit 162*a* of the open lever 160 to press the input unit 162*a* and rotates the open lever 160 around the open lever shaft 101 in a counterclockwise direction. On the other hand, a wall 174 surrounding the boss 172 concentrically is formed on the other surface of the cam gear 170. A hook 174*a* formed by a cut is provided on the wall 174. As shown in FIG. 22, the lock lever shaft 102 provided on the unit holder 50B supports the surface of the cam gear 170, on which the cam wall 173 is formed, toward a surface of the unit holder 50B.

Figure 26:
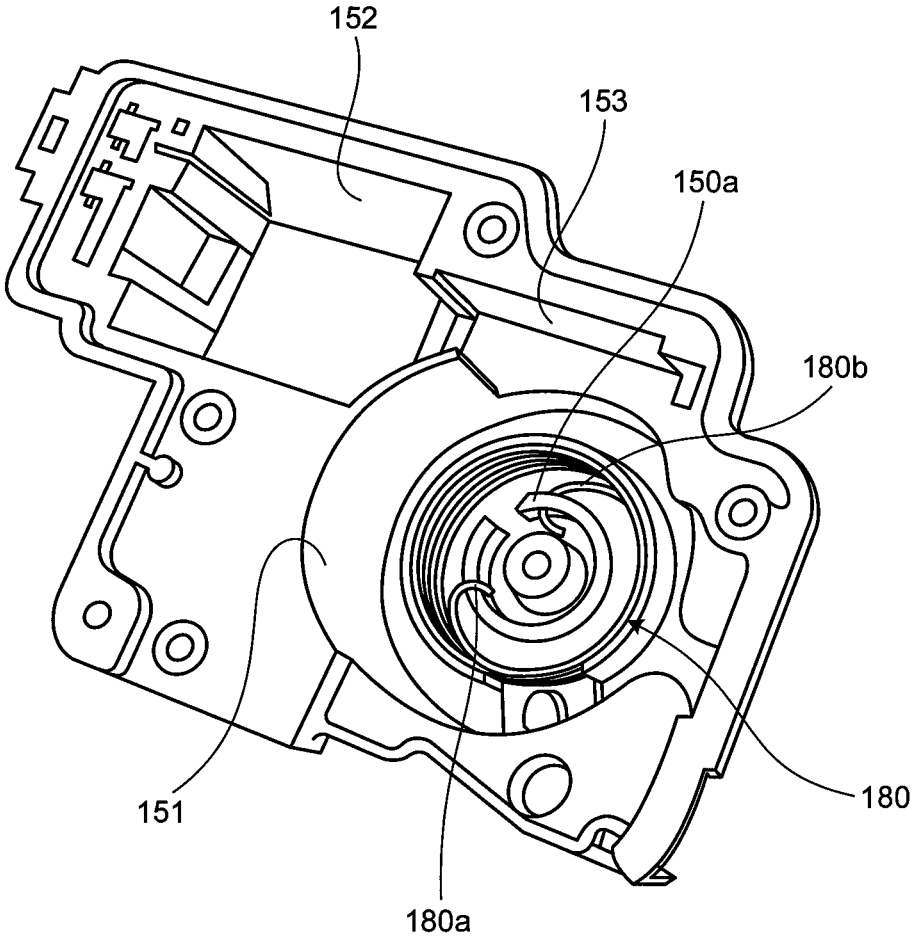
FIG. 26 is a perspective view of a unit cover for depicting a state of arranging a return spring in the unit cover.

FIG. 26 is a perspective view of the unit cover 150 for depicting a state of arranging the return spring 180 in the unit cover 150. The return spring 180 is a coiled spring returning the cam gear 170 that rotates about the center of the lock lever 102 by driving the electric motor 110 to a position before rotation. The return spring 180 is accommodated in an operation concave portion 151 of the unit cover 150 while latching one end 180*a* of the return spring 180 on the hook 174*a* of the cam gear 170 (see FIG. 25B), and latching the other end 180*b* thereof on a hook 150*a* formed on the unit cover 150.

In the vehicle latch device LA2 configured as described above, when the latch 20 of the closed back door D is to be disengaged from the ratchet 30, the electric motor 110 is driven in a state of closing the back door D, and the cam gear 170 rotates about the lock lever shaft 102 in a clockwise direction in FIG. 23.

Figure 27:
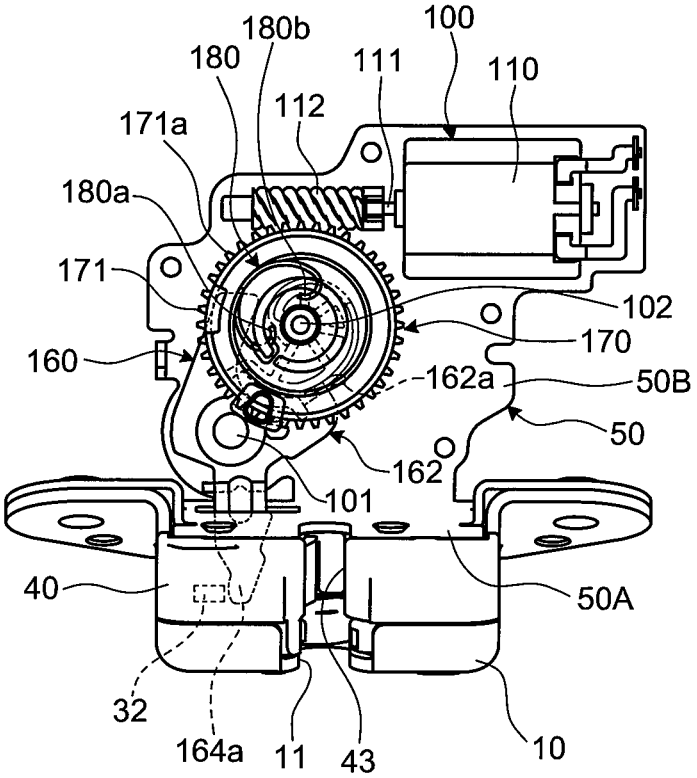
FIG. 27 is a front view of a disengagement state where a latch is disengaged from a ratchet when an electric motor of the vehicle latch device shown in FIG. 22 is driven to rotate the cam gear and an output unit of the open lever presses a first releasing operation unit of the ratchet.

The cam wall 173 then abuts on the input unit 162*a* to press the input unit 162*a* following rotation of the cam gear 170, and the open lever 160 rotates about the center of the open lever shaft 101 in a clockwise direction. As a result, as shown in FIG. 27, the output unit 164*a* of the open lever 160 presses the first releasing operation unit 32 of the ratchet 30 leftward in FIG. 27, thereby disengaging the latch 20 from the ratchet 30.

As a result, the position of the latch 20 is switched to the unlatched position shown in FIG. 5A. Therefore, a passenger can easily open the back door D.

An urging force of urging the cam gear 170 in a reverse rotation direction is accumulated in the return spring 180 following rotation of the cam gear 170. Accordingly, when the latch 20 is disengaged from the ratchet 30 and the electric motor 110 stops being driven, the urging force accumulated in the return spring 180 returns the cam gear 170 and the worm gear 112 to initial positions shown in FIGS. 20 to 23 and the open lever spring returns the open lever 160 to an initial position shown in FIGS. 20 to 23.

As described above, the input unit 162*a* of the open lever 160 of the vehicle latch device LA2 is arranged to be superimposed on and parallel to the plane of rotation of the cam gear 170, and the vehicle latch device LA2 includes the unit cover 150 which is attached to the unit holder 50B and with which at least the open lever shaft 101 supporting the open lever 160, the input unit 162*a* of the open lever 160, the electric motor 110, and the cam gear 170 are covered. This can suppress entry of water into the vehicle latch device LA2 while preventing the vehicle latch device LA2 from being made larger.

Figure 28A:
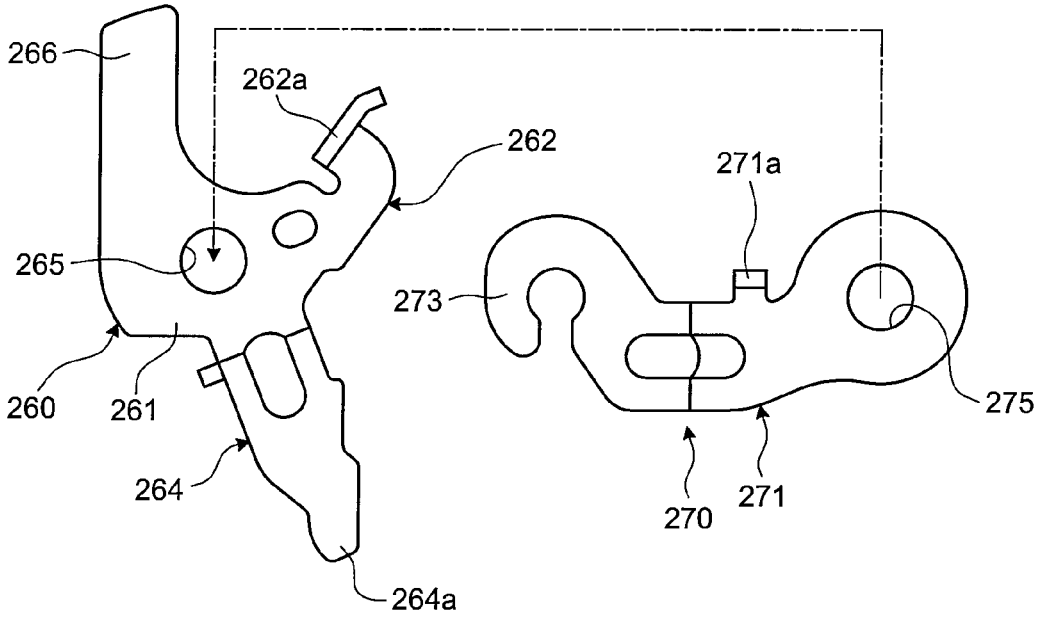
FIGS. 28A and 28B are front views of another configuration of an open lever according to a modification of the second embodiment.
Figure 28B:
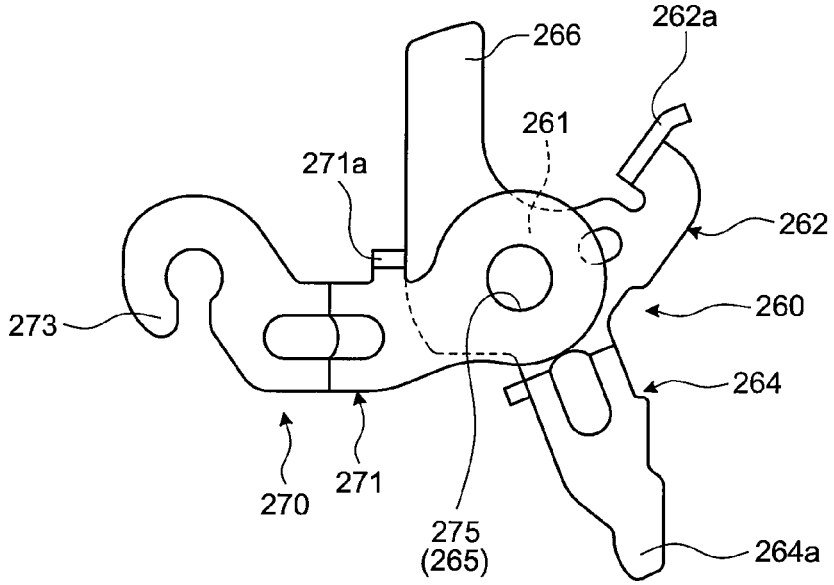

Alternatively, as shown in FIGS. 28A and 28B, a divisible open lever obtained by a combination of an open lever 260 and a cable lever 270 can be used in place of the open lever 160. As shown in FIG. 28A, the open lever 260 is configured so that, out of three arms extending in three directions with respect to a shaft hole 265 formed in a main body 261, respectively, an input unit 262*a* is formed on an end of an input arm 262 and an output unit 264*a* is formed on an end of an output arm 264. The remaining arm serves as a stopper arm 266.

Meanwhile, as shown in FIG. 28A, the cable lever 270 is configured so that a cable engaging unit 273 is formed on one end of a main body arm 271 and so that a shaft hole 275 into which the open lever shaft 101 is inserted is formed on the other end thereof. Further, a stopper piece 271*a* is provided on a side edge of the main body arm 271 near the shaft hole 275. Note that one end of the operation cable C (see FIG. 2) connecting the vehicle latch device LA2 to the operation handle provided in a vehicle interior of the vehicle main body B or the back door D is engaged with the cable engaging unit 273.

As shown in FIG. 28B, the open lever 260 and the cable lever 270 are integrated by superimposing the shaft hole 265 on the shaft hole 275 and abutting the stopper piece 271*a* on a side edge of the stopper arm 266. The open lever shaft 101 provided on the unit holder 50B can rotatably support the integrated open lever 260 and the cable lever 270.

In the second embodiment, an example of disengaging the latch 20 from the ratchet 30 when the vehicle latch device LA2 is at the fully latched position has been described. Needless to mention, the latch 20 can be disengaged from the ratchet 30 when the vehicle latch device LA2 is at the half latched position.

Moreover, similarly to the vehicle latch device LA1 according to the first embodiment, the vehicle latch device LA2 according to the second embodiment can disengage the ratchet 30 from the latch 20 by one action of inserting the tool R into the opening 45 at the time of emergency at which power cannot be supplied to the actuator unit 100 because of a failure in an electric system, running out of a battery or the like.

When the latch 20 is to be disengaged from the ratchet 30 by manipulating the operation handle provided in the vehicle interior of the vehicle main body B or the back door D to open the back door D, the following operation is performed. First, when the operation handle is manipulated to open the back door D, the operation cable C pulls the cable engaging unit 273.

Figure 29:
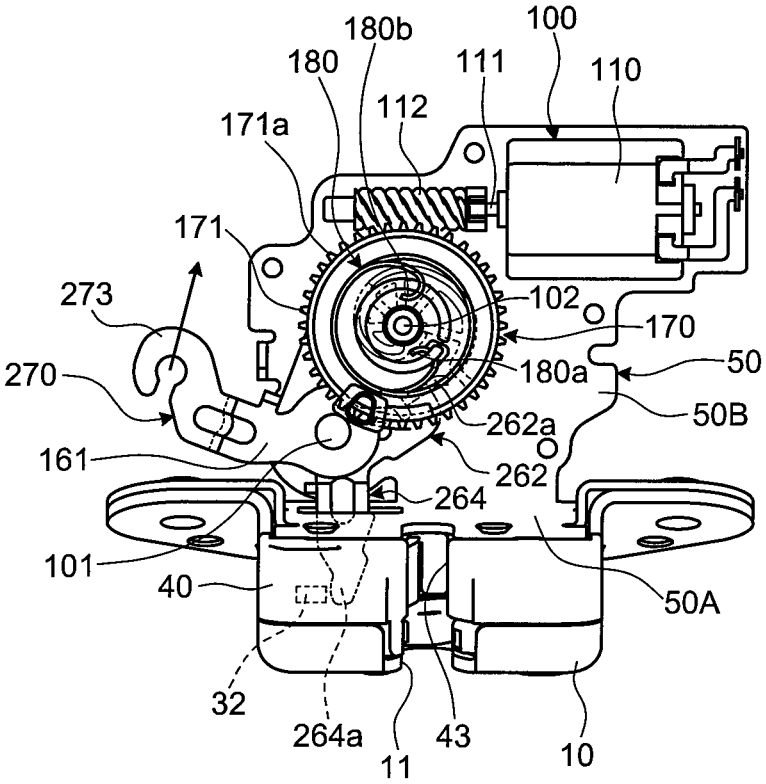
FIG. 29 is a front view of a disengagement state where the latch is disengaged from the ratchet when a first releasing operation unit of the ratchet is pressed by manipulating an operation handle to pull a cable engaging unit of the open lever in an arrow direction in a vehicle latch device using the open lever shown in FIGS. 28A and 28B.

With this operation, the open lever 260 as well as the cable lever 270 thereby rotates about the center of the open lever shaft 101 in a clockwise direction from the position of the open lever 160 shown in FIG. 22. Further, as shown in FIG. 29, the output unit 264*a* of the open lever 260 presses the first releasing operation unit 32 of the ratchet 30 leftward in FIG. 29. As a result, the latch 20 is disengaged from the ratchet 30 and the position of the latch 20 is switched to the unlatched position shown in FIG. 5A.

Accordingly, the passenger can open the back door D by one action of manipulating the operation handle provided in the vehicle-interior of the vehicle main body B or the back door D. When the latch 20 is disengaged from the ratchet 30 by manipulating the operation handle, then the open lever spring rotates the open lever 260 about the center of the open lever shaft 101 in a counterclockwise direction to return the open lever 260 to an original position by stopping manipulating the operation handle to open the back door D.

In the vehicle latch device LA1 according to the first embodiment, the cable lever 120 and the open lever 130 serving as the releasing unit and the lock lever 140 serving as the gear member are arranged in the operation concave portion 151 of the unit cover 150. In the vehicle latch device LA2 according to the second embodiment, the open lever 160 serving as the releasing unit and the cam gear 170 serving as the gear member are arranged in the operation concave portion 151 of the unit cover 150. Therefore, the same unit cover 150, the same main-unit body 40, and the same back plate 50 can be shared between the vehicle latch device LA1 according to the first embodiment and the vehicle latch device LA2 according to the second embodiment.

With this configuration, the vehicle latch device according to the present invention can be configured as an electrically releasable vehicle latch device or an electrically locking/unlocking door latch device depending on whether members arranged in the operation concave portion 151 of the unit cover 150 are the cable lever 120, the open lever 130, and the lock lever 140 or the open lever 160 and the cam gear 170, while using the same unit cover 150, the same main-unit body 40, and the same back plate 50. Accordingly, the flexibility on use increases and the members can be arranged in the common operation concave portion 151 of the unit cover 150, thereby facilitating an operation of attaching the vehicle latch device according to the present invention to a vehicle.

According to the present invention, the input unit of the releasing unit is arranged to be superimposed on a plane of rotation of the gear member, and the vehicle latch device includes the cover member which is attached to the holding member and with which at least the support shaft and the input unit of the releasing unit, the electric actuator, and the gear member are covered. Therefore, it is possible to suppress entry of water into the vehicle latch device while preventing the vehicle latch device from being made larger.

This application claims priority from Japanese Patent Application 2010-109603, filed May 11, 2010, which is incorporated herein by reference in its entirety.

What is claimed is:

1. A vehicle latch device comprising:

a releasing unit configured to rotate about a first support shaft provided on a holding member of an electric actuator, and which includes an input unit configured to permit a driving force of the electric actuator to be input, and an output unit configured to disengage a latch from a ratchet by rotation of the releasing unit about the first support shaft;

a gear member configured to rotate about a second support shaft provided on the holding member, connect the electric actuator to the releasing unit, and input the driving force of the electric actuator into the input unit; and a cover member that is attached to the holding member and covers at least the first support shaft, the second support shaft, the input unit, the electric actuator, and the gear member, wherein the second support shaft is provided at a first position closer to a center of a holding surface of the holding member on which the electric actuator is held than the first support shaft, and wherein the input unit is arranged so as to be superimposed on a plane of rotation of the gear member at a second position closer to the center of the holding surface than the first support shaft.

2. The vehicle latch device according to claim 1, wherein the gear member is a lock lever including:

a gear unit engaged with a worm gear provided on the electric actuator; and a cam groove with which the input unit is slidably engaged, and wherein the releasing unit includes:

a cable lever supported by the first support shaft, the cable lever including a cable engaging unit, one end of an operation cable connecting the vehicle latch device to an operation handle being engaged with the cable engaging unit, an operation output unit configured to output an operation force of the operation handle transmitted via the operation cable to the input unit; and an open lever that includes an input arm and an output arm, wherein the open lever is configured to rotate about the first support shaft, a slider provided with the input unit is provided on the input arm so as to be movable along a longitudinal direction of the input arm, and the output unit is provided on an end of the output arm.

3. The vehicle latch device according to claim 1, wherein the gear member is a cam gear including:

a gear unit engaged with a worm gear provided on the electric actuator; and a cam wall with which the input unit is slidably engaged, wherein the releasing unit includes an open lever including an input arm provided with the input unit and an output arm configured such that the output unit is provided on an end of the output arm, and wherein the open lever is configured to transmit an input from the input unit to the output unit.

4. The vehicle latch device according to claim 3, wherein the first support shaft and the second support shaft, the open lever is configured to rotate about the first support shaft, and the cam gear is configured to rotate about the second support shaft.

5. A vehicle latch device comprising:

a releasing unit configured to rotate about a first support shaft provided on a holding member of an electric actuator, and which includes an input unit configured to permit a driving force of the electric actuator to be input, and an output unit configured to disengage a latch from a ratchet by rotation of the releasing unit about the first support shaft;

a gear member configured to rotate about a second support shaft, connect the electric actuator to the releasing unit, and input the driving force of the electric actuator into the input unit; and a cover member that is attached to the holding member and covers at least the first support shaft, the second support shaft, the input unit, the electric actuator, and the gear member, wherein the input unit is arranged so as to be superimposed on a plane of rotation of the gear member, wherein the gear member is a lock lever including:

a gear unit engaged with a worm gear provided on the electric actuator; and a cam groove with which the input unit is slidably engaged, and wherein the releasing unit includes:

a cable lever supported by the first support shaft, the cable lever including a cable engaging unit, one end of an operation cable connecting the vehicle latch device to an operation handle being engaged with the cable engaging unit, an operation output unit configured to output an operation force of the operation handle transmitted via the operation cable to the input unit; and an open lever that includes an input arm and an output arm, wherein the open lever is configured to rotate about the first support shaft, a slider provided with the input unit is provided on the input arm so as to be movable along a longitudinal direction of the input arm, and the output unit is provided on an end of the output arm.

* * * * *